US010624423B2

(12) United States Patent
Orand et al.

(10) Patent No.: US 10,624,423 B2
(45) Date of Patent: Apr. 21, 2020

(54) ARTICLE OF FOOTWEAR WITH A PULLEY SYSTEM HAVING A GUIDE PORTION

(71) Applicant: NIKE, Inc., Beaverton, OR (US)

(72) Inventors: Austin Orand, Portland, OR (US); Timothy P. Hopkins, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 70 days.

(21) Appl. No.: 15/243,138

(22) Filed: Aug. 22, 2016

(65) Prior Publication Data

US 2017/0332735 A1 Nov. 23, 2017

Related U.S. Application Data

(63) Continuation-in-part of application No. 15/158,045, filed on May 18, 2016.

(51) Int. Cl.

| | |
|---|---|
| ***A43C 1/00*** | (2006.01) |
| ***A43C 11/00*** | (2006.01) |
| ***A43C 11/16*** | (2006.01) |

(52) U.S. Cl.

CPC ..... *A43C 11/008* (2013.01); *A43C 1/00* (2013.01); *A43C 1/003* (2013.01); *A43C 11/165* (2013.01)

(58) Field of Classification Search

CPC ..... A43B 1/003; A43B 11/165; A43B 11/008; Y10T 24/2183; Y10T 24/2187

USPC ..... 24/713.2, 713.5

See application file for complete search history.

(56) References Cited

U.S. PATENT DOCUMENTS

| | | | | |
|---|---|---|---|---|
| 1,613,071 | A | 1/1927 | Williams | |
| 4,139,044 | A | 2/1979 | Brolin | |
| 4,883,238 | A | 11/1989 | Harder | |
| 5,463,822 | A * | 11/1995 | Miller | A43C 11/00 36/50.1 |
| 6,671,980 | B1 * | 1/2004 | Liu | A43B 11/00 24/712 |
| 6,691,433 | B2 * | 2/2004 | Liu | A43B 3/0005 24/68 SK |

(Continued)

FOREIGN PATENT DOCUMENTS

| | | | |
|---|---|---|---|
| CN | 109195473 | A | 1/2019 |
| DE | 1901341 | U | 9/1964 |

(Continued)

OTHER PUBLICATIONS

"U.S. Appl. No. 15/158,045, Response filed Apr. 9, 2018 to Restriction Requirement dated Feb. 8, 2018", 9 pgs.

(Continued)

*Primary Examiner* — Sharon M Prange

(74) *Attorney, Agent, or Firm* — Schwegman Lundberg & Woessner, P.A.

(57) ABSTRACT

A tensioning system for use with an article of footwear includes a pulley assembly. The pulley assembly may include a first disc and a second disc connected by a central shaft. A tensioning element can be engaged around the central shaft. A ring element can be used to prevent the tensioning element from disengaging the pulley when there is slack in the tensioning element. The pulley assembly can include a guide portion that guides a tensioning member so as to restrict the entry angle of segments of the tensioning member.

18 Claims, 27 Drawing Sheets

(56) References Cited

U.S. PATENT DOCUMENTS

| | | | | |
|---|---|---|---|---|
| 6,735,829 | B2 * | 5/2004 | Hsu | A43C 3/00 24/130 |
| 9,365,387 | B2 | 6/2016 | Beers et al. | |
| 2003/0204970 | A1 | 11/2003 | Liu | |
| 2012/0246897 | A1 | 10/2012 | Lee | |
| 2014/0068838 | A1 | 3/2014 | Beers et al. | |
| 2014/0082963 | A1 | 3/2014 | Beers | |
| 2014/0223779 | A1 | 8/2014 | Elder et al. | |
| 2015/0040429 | A1 | 2/2015 | Beers | |
| 2015/0059206 | A1 | 3/2015 | Lovett et al. | |
| 2015/0121669 | A1 | 5/2015 | Jungkind | |
| 2016/0058129 | A1 * | 3/2016 | Krueger | A43C 1/00 36/114 |
| 2016/0286903 | A1 * | 10/2016 | Whewell | A43C 11/20 |
| 2016/0345680 | A1 * | 12/2016 | Rhulen | A43C 5/00 |
| 2017/0215525 | A1 * | 8/2017 | Labbe | A43B 11/00 |
| 2017/0332734 | A1 | 11/2017 | Orand | |

FOREIGN PATENT DOCUMENTS

| | | | |
|---|---|---|---|
| DE | 3911012 | A1 | 10/1990 |
| DE | 4412812 | A1 | 10/1995 |
| WO | WO-7900770 | A1 | 10/1979 |
| WO | WO-9522917 | A1 | 8/1995 |
| WO | 2007008352 | | 1/2007 |
| WO | WO-2008015214 | A1 | 2/2008 |
| WO | WO-2015014374 | A1 | 2/2015 |
| WO | WO-2016015161 | A1 | 2/2016 |
| WO | WO-2017201045 | A1 | 11/2017 |

OTHER PUBLICATIONS

"U.S. Appl. No. 15/158,045, Restriction Requirement dated Feb. 8, 2018", 6 pgs.
"International Application Serial No. PCT/US2017/032900, International Search Report dated Aug. 25, 2017", 4 pgs.
"International Application Serial No. PCT/US2017/032900, Written Opinion datead Aug. 25, 2017", 5 pgs.
"U.S. Appl. No. 15/158,045, Examiner Interview Summary dated Aug. 28, 2018", 2 pgs.
"U.S. Appl. No. 15/158,045, Non Final Office Action dated Jun. 21, 2018", 12 pgs.
"U.S. Appl. No. 15/158,045, Response filed Oct. 22, 2018 to Non Final Office Action dated Jun. 21, 2018", 9 pgs.
"International Application Serial No. PCT/US2017/032900, International Preliminary Report on Patentability dated Nov. 29, 2018", 7 pgs.
"U.S. Appl. No. 15/158,045, Final Office Action dated Feb. 25, 2019", 8 pgs.
"U.S. Appl. No. 15/158,045, Response filed May 28, 2019 to Final Office Action dated Feb. 25, 2019", 7 pgs.
"U.S. Appl. No. 15 158,045, Non Final Office Action dated Dec. 2, 2019", 11 pgs.
"European Application Serial No. 17800011.3, Response filed Jul. 19, 2019 to Communication Pursuant to Rules 161 and 162 dated Jan. 11, 2019", 11 pgs.
"Eurpoean Application Serial No. 17800011.3, Extended European Search Report dated Dec. 20, 2019", 7 pgs.

* cited by examiner

ARTICLE OF FOOTWEAR WITH A PULLEY SYSTEM HAVING A GUIDE PORTION

REFERENCE TO RELATED APPLICATIONS

This application is a continuation-in-part of Orand, U.S. patent application Ser. No. 15/158,045, filed May 18, 2016, and titled "Article of Footwear with a Pulley System", the entirety of which is herein incorporated by reference.

BACKGROUND

The present embodiments relate generally to articles of footwear, and in pmiicuiar to systems for tensioning articles of footwear.

Articles of footwear generally include two primary elements: an upper and a sole structure. The upper may be formed from a variety of materials that are stitched or adhesively bonded together to form a void within the footwear for comfortably and securely receiving a foot. The sole structure is secured to a lower portion of the upper and is generally positioned between the foot and the ground. In many articles of footwear, including athletic footwear styles, the sole structure often incorporates an insole, a midsole, and an outsole.

SUMMARY

In one embodiment, a pulley assembly comprises a pulley having a first disc, a second disc, and a central shaft extending between the first disc and the second disc. The pulley including a circumferential gap disposed between the first disc and the second disc and bounded in a radial direction by the central shaft. The pulley includes an aperture extending through the central shaft. An external pulley housing including an external ring portion and a guide portion. The guide portion extends from the external ring portion, and the guide portion includes an open chamber. The guide portion includes a top opening and an opposing bottom opening that provide access to the open chamber. The guide portion includes a distal opening on a distal end of the guide portion that provides access to the open chamber.

In another aspect, a tensioning system for an article of footwear includes a pulley assembly with a pulley having a first disc, a second disc, and a central shaft extending between the first disc and the second disc. The pulley includes a circumferential gap disposed between the first disc and the second disc and bounded in a radial direction by the central shaft. The pulley includes an aperture extending through the central shaft. The pulley assembly includes an external pulley housing including an external ring portion and a guide portion. The guide portion extends from the external ring portion, and the guide portion includes an open chamber. The guide portion includes a top opening and an opposing bottom opening that provide access to the open chamber. The guide portion includes a distal opening on a distal end of the guide portion that provides access to the open chamber. The system includes a first tensioning member with a portion extending around the central shaft and a second tensioning member with a portion extending through the aperture.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
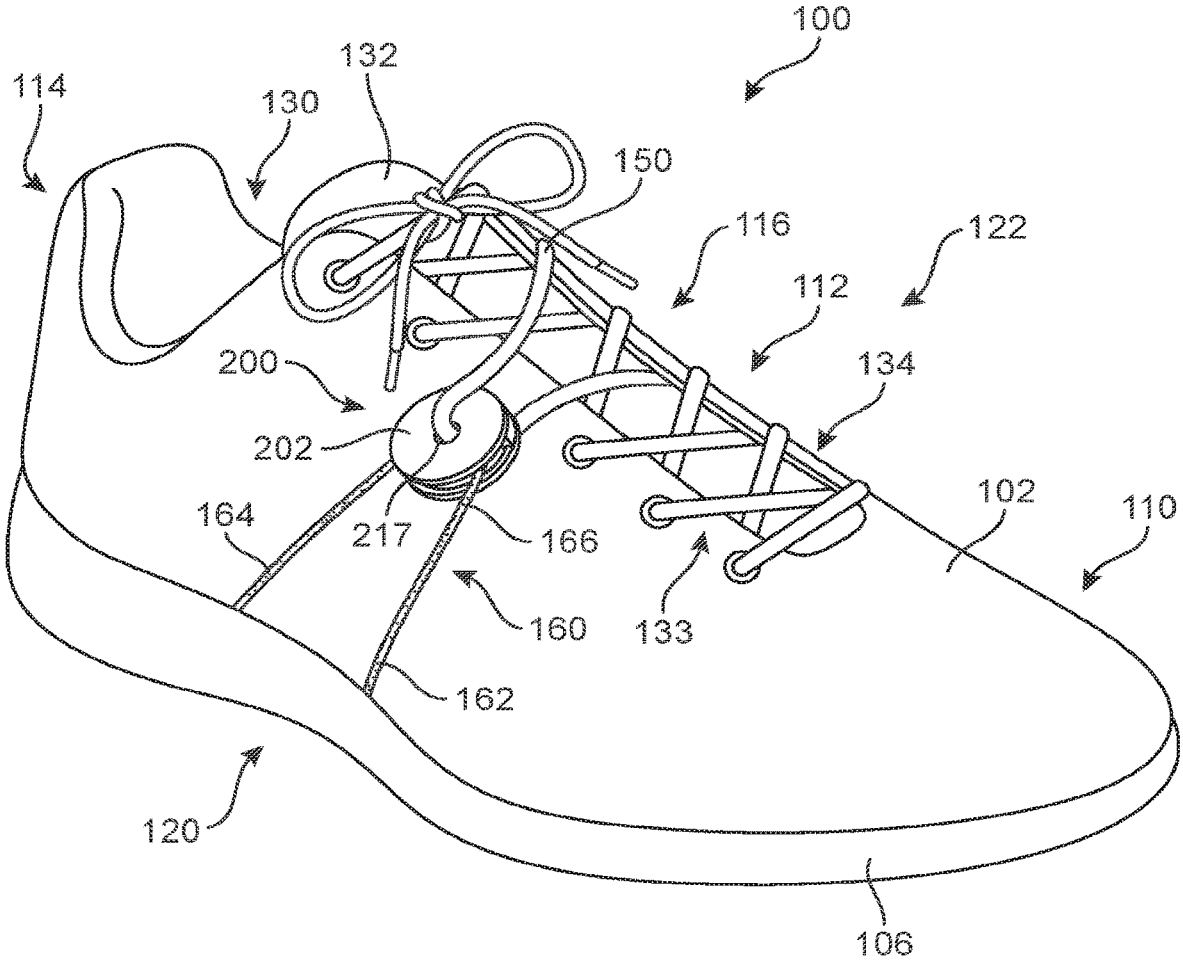
FIG. 1 is a schematic isometric view of an embodiment of an article of footwear with a dynamic tensioning system.

FIG. 1 is a schematic view of article of footwear 100 that further includes dynamic tensioning system 200. In one embodiment, article of footwear 100 has the form of an athletic shoe. The provisions discussed herein for dynamic tensioning system 200 could be incorporated into various other kinds of footwear including, but not limited to, basketball shoes, hiking boots, soccer shoes, football shoes, tennis shoes, climbing shoes, sneakers, running shoes, cross-training shoes, rugby shoes, rowing shoes, baseball shoes as well as other kinds of shoes. Moreover, in some embodiments, the provisions discussed herein could be incorporated into various other kinds of non-sports-related footwear, including, but not limited to, slippers, sandals, high-heeled footwear, and loafers.

For purposes of clarity, the following detailed description discusses the features of article of footwear 100, also referred to simply as article 100. However, it will be understood that other embodiments may incorporate a corresponding article of footwear (e.g., a right article of footwear when article 100 is a left article of footwear) that may share some, and possibly all, of the features of article 100 described herein and shown in the figures.

The embodiments may be characterized by various directional adjectives and reference portions. These directions and reference portions may facilitate in describing the portions of an article of footwear. Moreover, these directions and reference portions may also be used in describing subcomponents of an article of footwear (e.g., directions and/or portions of a midsole structure, an outer sole structure, a tensioning system, an upper, or any other components).

For consistency and convenience, directional adjectives are employed throughout this detailed description corresponding to the illustrated embodiments. The term "longitudinal" as used throughout this detailed description and in the claims refers to a direction or axis extending a length of a component (e.g., an upper or sole component). In some embodiments, a longitudinal direction may extend from a forefoot portion to a heel portion of the component. Also, the term "lateral" as used throughout this detailed description and in the claims refers to a direction or axis extending along a width of a component. For example, a lateral direction may extend between a medial side and a lateral side of a component. Furthermore, the term "vertical" as used throughout this detailed description and in the claims refers to a direction or axis generally perpendicular to a lateral and longitudinal direction. For example, in embodiments where an article is planted flat on a ground surface, a vertical direction may extend from the ground surface upward. Additionally, the term "inner" or "proximal" refers to a portion of an article disposed closer to an interior of an article, or closer to a foot when the article is worn. Likewise, the term "outer" or "distal" refers to a portion of an article disposed further from the interior of the article or from the foot. Thus, for example, the proximal surface of a component is disposed closer to an interior of the article than the distal surface of the component. This detailed description makes use of these directional adjectives in describing an article and various components of the article, including an upper, a midsole structure, and/or an outer sole structure.

Article 100 may be characterized by a number of different regions or portions. For example, article 100 could include a forefoot region, a midfoot region, a heel region, a vamp region, and an instep region. Moreover, components of article 100 could likewise comprise corresponding regions or portions. Referring to FIG. 1, article 100 may be divided into forefoot region 110, midfoot region 112, and heel region 114. Forefoot region 110 may be generally associated with the toes and joints connecting the metatarsals with the phalanges. Midfoot region 112 may be generally associated with the arch of a foot. Likewise, heel region 114 may be generally associated with the heel of a foot, including the calcaneus bone. Article 100 may also include instep region 116.

Furthermore, for purposes of reference, article 100 may include lateral side 120 and medial side 122. In particular, lateral side 120 and medial side 122 may be opposing sides of article 100. Furthermore, both lateral side 120 and medial side 122 may extend through forefoot region 110, midfoot region 112, heel region 114.

Article 100 may comprise upper 102 and sole structure 106. In different embodiments, sole structure 106 may be configured to provide traction for article 100. Thus, in some embodiments, traction elements may be included in sole structure 106. In addition to providing traction, sole structure 106 may attenuate ground reaction forces when compressed between the foot and the ground during walking, running, pushing, or other ambulatory activities. The configuration of sole structure 106 may vary significantly in different embodiments to include a variety of conventional or nonconventional structures. In some embodiments, the configuration of sole structure 106 can be configured according to one or more types of surfaces on which sole structure 106 may be used. Examples of surfaces include, but are not limited to, natural turf, synthetic turf, dirt, hardwood flooring, skims, wood, plates, footboards, boat ramps, as well as other surfaces.

The various portions of sole structure 106 may be formed from a variety of materials. For example, sole structure 106 may include a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, sole structure 106 may incorporate fluid-filled chambers, plates, moderators, or other elements that further attenuate forces, enhance stability, or influence the motions of the foot. Furthermore, other portions of sole structure 106, such as an outsole, can be formed from a wear-resistant rubber material that is textured to impart traction. It should be understood that the embodiments herein depict a configuration for sole structure 106 as an example of a sole structure that may be used in connection with upper 102, and a variety of other conventional or nonconventional configurations for sole structure 106 may also be utilized. Accordingly, the structure and features of sole structure 106 or any sole structure utilized with upper 102 may vary considerably.

Sole structure 106 is secured to upper 102 and extends between a foot and the ground when article 100 is worn. In different embodiments, sole structure 106 may include different components. For example, sole structure 106 may include an outsole. Sole structure 106 may further include a midsole and/or an insole. In some embodiments, one or more of these components may be optional.

In different embodiments, upper 102 may be joined to sole structure 106 and define an interior cavity designed to receive a wearer's foot. In some embodiments, upper 102 includes opening 130 that provides access for the foot into an interior cavity of upper 102. Opening 130 may be disposed along or near the ankle portion in some embodiments. As seen in FIG. 1, in one embodiment upper 102 also includes tongue 132. Tongue 132 may be disposed against throat opening 134 (of throat 133 of upper 102) and tongue 132 may block access to the interior cavity of upper 102 via throat opening 134.

In some embodiments, an article can include fastening provisions. Some embodiments may include a tensioning element, which may also be referred to as a tensioning member. The term "tensioning element" as used throughout this detailed description and in the claims refers to any component that has a generally elongated shape and high tensile strength. In some cases, a tensioning element could also have a generally low elasticity. Examples of different tensioning elements include, but are not limited to, laces, cables, straps, and cords. In some cases, tensioning elements may be used to fasten and/or tighten an article, including articles of clothing and/or footwear. In other cases, tensioning elements may be used to apply tension at a predetermined location for purposes of actuating some components or system.

As shown in FIG. 1, article 100 includes tensioning element 150 (e.g., a lace) that is used to close throat opening 134 and thereby adjust the size of throat 133. Furthermore, tensioning element 150 can be used to facilitate entry and removal of upper 102 around a foot. While the embodiment of FIG. 1 utilizes a lace, other tensioning elements could be used in other embodiments, including, but not limited to, straps, cords, cables, wires, as well as other kinds of tensioning elements. Moreover, embodiments could include any other kinds of fastening provisions such as loops, eyelets, D-rings, or other provisions that may facilitate the fastening of an article using one or more tensioning elements.

In the embodiment of FIG. 1, article 100 also includes another tensioning element 160. In some embodiments, tensioning element 160 could be a wire or cable. Tensioning element 160 may be secured to any portion of article 100. In some embodiments, tensioning element 160 may include first end 162 and second end 164, both secured to a strobel layer or generally at the location where upper 102 is secured with sole structure 106. Intermediate portion 166 of tensioning element 160 may then be coupled with tensioning element 150 so that tension applied to the laces can be used to pull tensioning element 160 and thus help improve support along lateral side 120 of upper 102.

Embodiments can include provisions for dynamically coupling two or more tensioning elements. Dynamically coupling two tensioning elements may allow the tension to be distributed across the elements so as to best balance the loads applied across the upper and foot, which may facilitate improved comfort and fit. In some embodiments, a pulley may be used to couple two or more tensioning elements in a dynamic way. In other embodiments, other provisions could be used to dynamically couple two or more tensioning elements. Of course, in other embodiments, two or more tensioning elements could be coupled in a static way, for example, by tying one tensioning element to a portion of another tensioning element.

In the embodiment shown in FIG. 1, article 100 includes pulley assembly 202. Together, pulley assembly 202, tensioning element 150 and tensioning element 160, may collectively comprise dynamic tensioning system 200. As discussed in further detail below, pulley assembly 202 facilitates the transfer of tension between tensioning element 150 and tensioning element 160 in a way that may best balance loads across upper 102, since both tensioning element 150 and tensioning element 160 may be capable of moving relative to pulley assembly 202.

Figure 2:
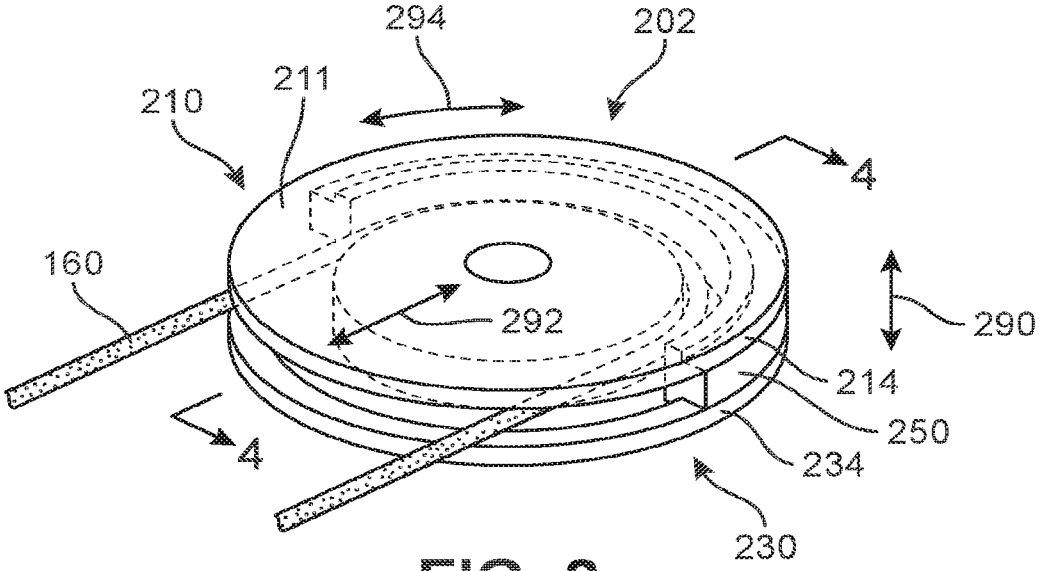
FIG. 2 is a schematic isometric view of some components of the dynamic tensioning system of FIG. 1, including a pulley assembly.
Figure 3:
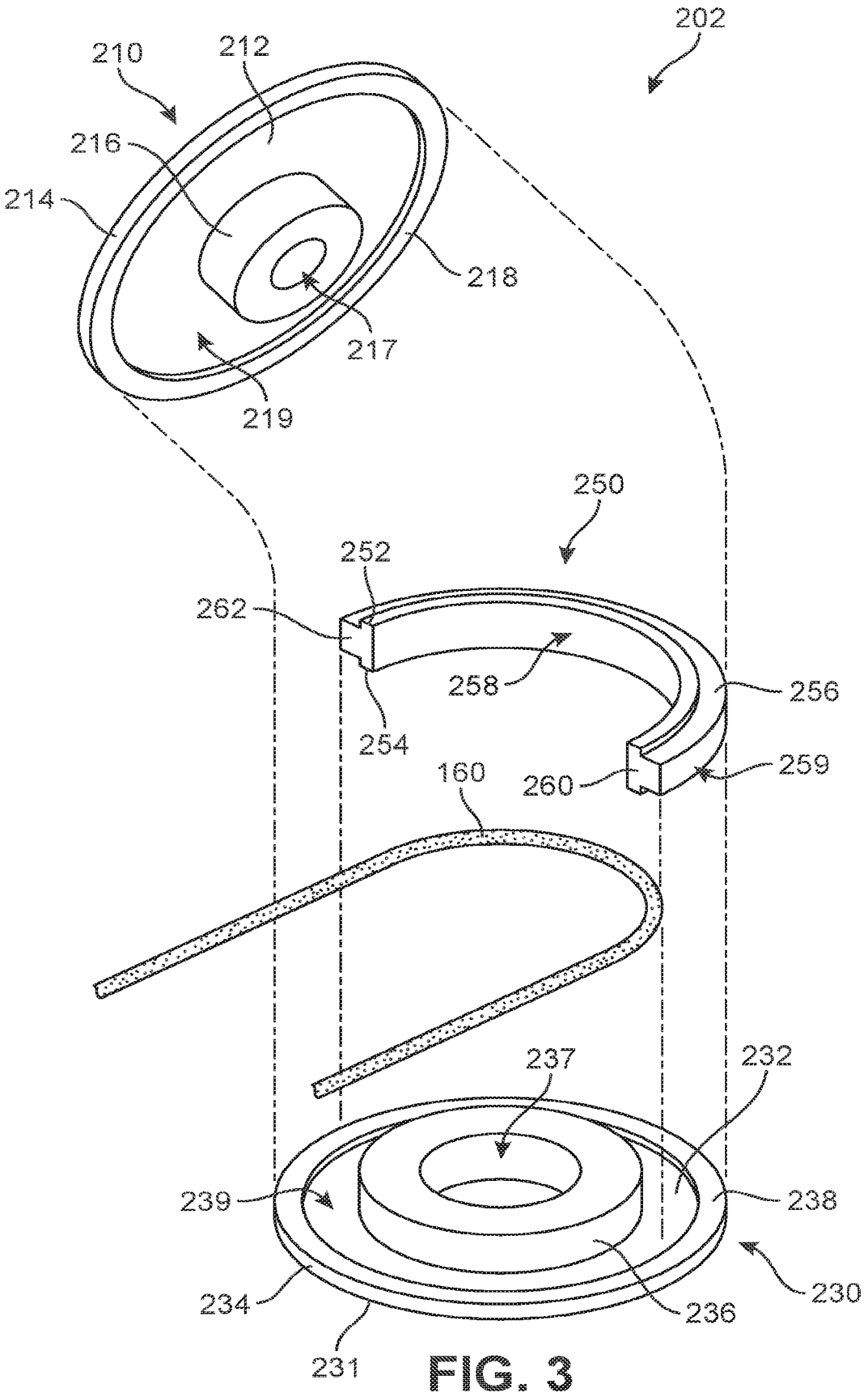
FIG. 3 is a schematic exploded view of the components of FIG. 2.

FIG. 2 is an isometric view of an embodiment of pulley assembly 202 as well as portions of tensioning element 160. FIG. 3 is an exploded isometric view of the components shown in FIG. 2.

As shown in the figures, each pulley assembly generally has a geometry that can be characterized by radial, axial, and circumferential directions. Referring to FIG. 2, pulley assembly 202 may be associated with set of axial directions 290 (or simply axial directions 290), set of radial directions 292 (or simply radial directions 292), and set of circumferential directions 294 (or simply circumferential directions 294). Thus, axial directions 290 may coincide with the thickness of pulley assembly 202, while radial directions 292 are associated with the radius of pulley assembly 202. Circumferential directions 294 are associated with the circumference of the pulley, or the angular positions around the pulley.

Referring to FIGS. 2-3, pulley assembly 202 is comprised of a pair of discs, a center shaft, and an internal ring element that helps to prevent tensioning element 160 from falling off of pulley assembly 202 during use. Pulley assembly 202 may include first pulley member 210 and second pulley member 230. First pulley member 210 includes outer side 211 and inner side 212. First pulley member 210 may also be comprised of first disc 214 and first central axially extending portion 216. In addition, first pulley member 210 may be comprised of first peripheral axially extending portion 218, which may also be referred to as a lip. As seen in FIG. 3, first central axially extending portion 216 and first peripheral axially extending portion 218 extend from inner side 212, while outer side 211 has a generally flat surface (see FIG. 2). Moreover, shallow recess or groove 219 may be formed along inner side 212 between first central axially extending portion 216 and first peripheral axially extending portion 218.

In different embodiments, the geometry of first pulley member 210 could vary. First disc 214 may have a generally rounded or circular shape. First central axially extending portion 216 may have a cylindrical shape. Furthermore, first central axially extending portion 216 may include first central aperture 217. In some embodiments, including the embodiment shown in FIG. 3, first peripheral axially extending portion 218 may extend around the entire circumference of first pulley member 210. However, in other embodiments, first peripheral axially extending portion 218 may only extend around some portions of the circumference.

Second pulley member 230 includes outer side 231 and inner side 232. Second pulley member 230 may also be comprised of second disc 234 and second central axially extending portion 236. In addition, second pulley member 230 may be comprised of second peripheral axially extending portion 238, which may also be referred to as a lip. As seen in FIG. 3, second central axially extending portion 236 and second peripheral axially extending portion 238 extend from inner side 232, while outer side 231 has a generally flat surface that is similar to outer side 211 of first pulley member 210. Moreover, shallow recess or groove 239 may be formed along inner side 232 between second central axially extending portion 236 and second peripheral axially extending portion 238.

In different embodiments, the geometry of second pulley member 230 could vary. Second disc 234 may have a generally rounded or circular shape. Second central axially extending portion 236 may have a cylindrical shape. Furthermore, second central axially extending portion 236 may include second central aperture 237. In some embodiments, including the embodiment shown in FIG. 3, second peripheral axially extending portion 238 may extend around the entire circumference of second pulley member 230. However, in other embodiments, second peripheral axially extending portion 238 may only extend around some portions of the circumference.

Pulley assembly 202 may also include partial ring element 250, which is also referred to simply as ring element 250. Ring element 250 includes first retaining portion 252, second retaining portion 254, and outer portion 256. In addition, ring element 250 includes inward facing surface 258 and outward facing surface 259.

Figure 11:
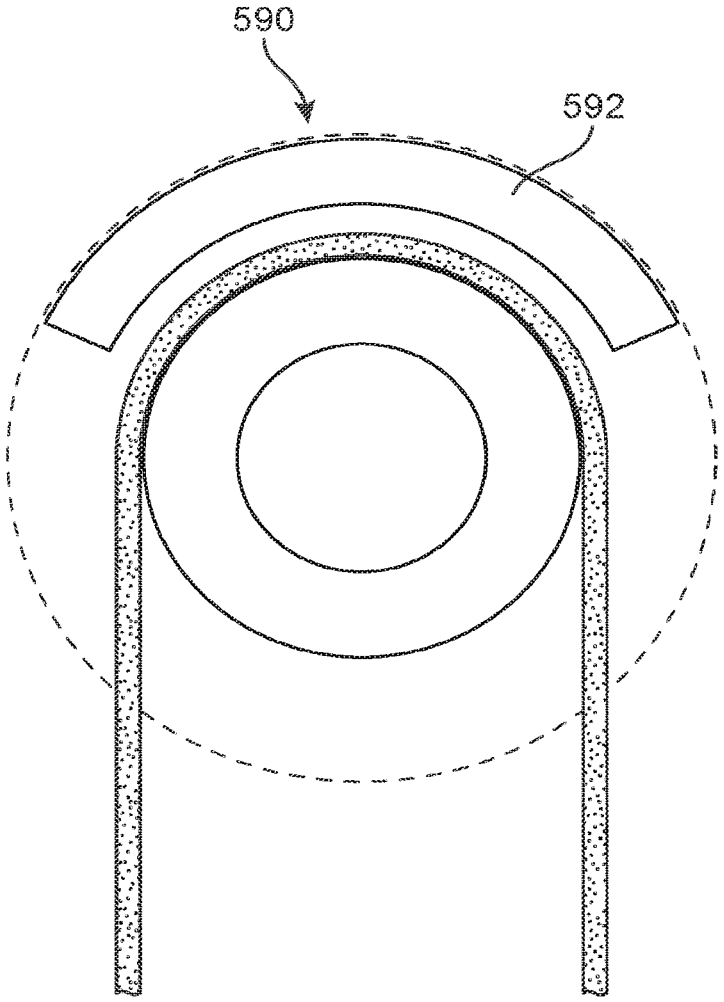
FIG. 11 is a schematic view of an embodiment of a pulley assembly with an internal partial ring element that extends less than 180 degrees through the circumferential direction.
Figure 12:
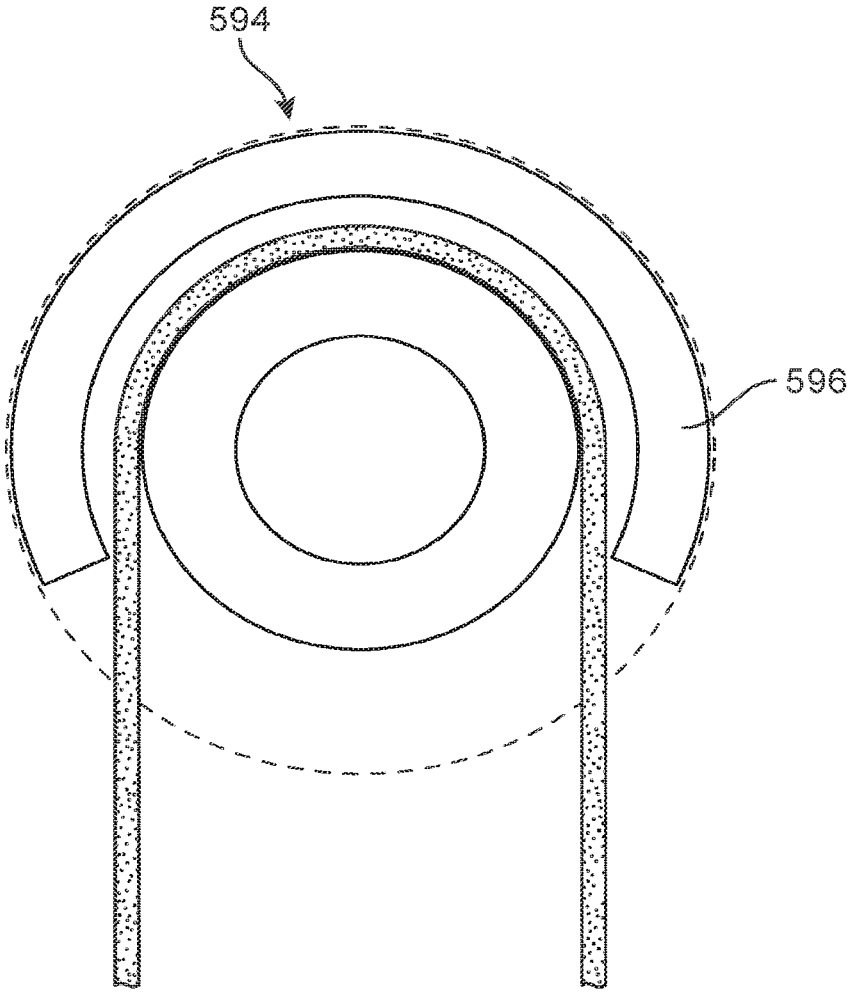
FIG. 12 is a schematic view of an embodiment of a pulley assembly with an internal partial ring element that extends more than 180 degrees through the circumferential direction.

In order to permit tensioning element 160 to pass between inward facing surface 258 and opposing surfaces of a pulley member, ring element 250 is configured as a partial ring. Specifically, ring element 250 includes first end 260 and second end 262 that are separated along the circumferential direction. In different embodiments, the circumferential extent of a partial ring element could vary. In some embodiments, a partial ring element could be a half-ring (i.e., extending around 180 degrees of a full circle or alternatively around half of the total circumference of a corresponding full ring). In other embodiments, a partial ring element could have an angular extent that is less than 180 degrees. For example, FIG. 11 illustrates another embodiment of pulley assembly 590 in which ring element 592 has an angular extent that is less than 180 degrees. In such an embodiment, ring element 592 has a length along the circumferential direction that is less than half of the total circumference of a corresponding circumferential gap of pulley assembly 590. In still other embodiments, a partial ring element could have an angular extent that is greater than 180 degrees. For example, FIG. 12 illustrates another embodiment of pulley assembly 594 in which ring element 596 has an angular extent that is greater than 180 degrees. In such an embodiment, ring element 596 has a length along the circumferential direction that is greater than half of the total circumference of a corresponding circumferential gap of pulley assembly 594. In the embodiment of FIGS. 2-3, ring element 250 comprises a partial ring that extends through approximately 180 degrees of a full circle or ring. In other words, ring element 250 has a length along the circumferential direction that is equal to half the circumference of circumferential gap 300 (see FIG. 4).

In different embodiments, the cross-sectional geometry of ring element 250 could vary. Some embodiments could utilize a rounded or circular cross section. In the embodiment shown in FIGS. 2-3, ring element 250 has a T-like cross-sectional shape due to the configuration of first retaining portion 252, second retaining portion 254, and outer portion 256. Moreover, the cross-sectional shape of ring element 250 (taken through a plane that is perpendicular to the circumferential direction) is approximately constant along the length of ring element 250.

Figure 4:
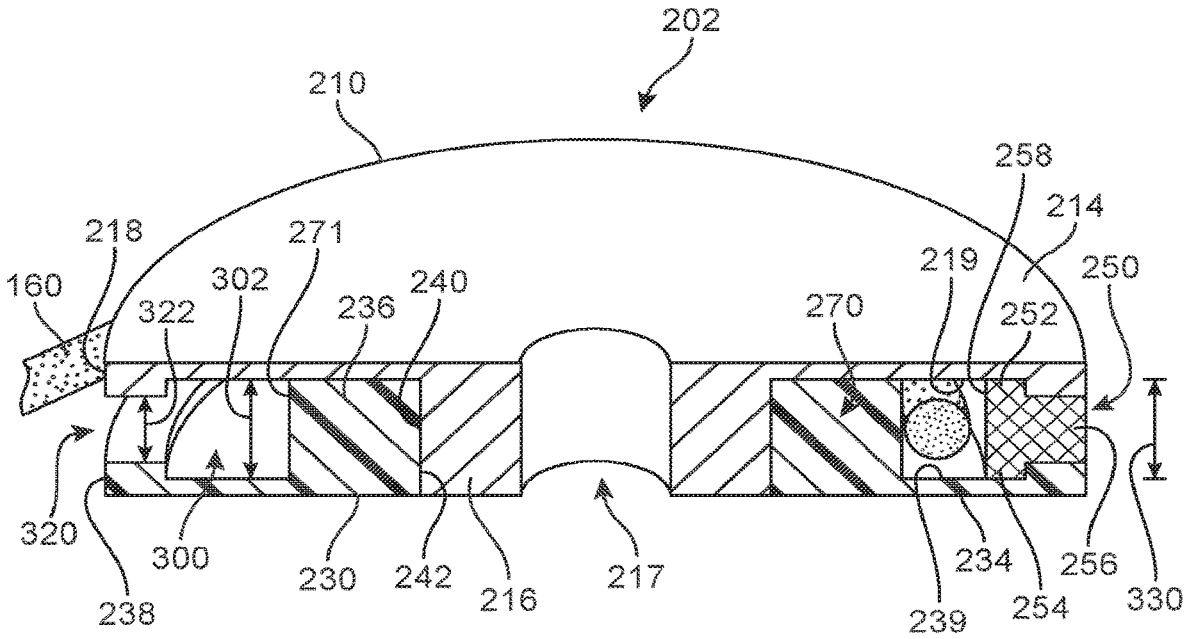
FIG. 4 is a schematic isometric cut-away view of the pulley assembly of FIG. 2.

FIG. 4 is a cross-sectional view of pulley assembly 202, as indicated in the view of FIG. 2. Referring to FIG. 4, first pulley member 210 may be permanently attached or joined with second pulley member 230. Specifically, first central axially extending portion 216 of first pulley member 210 may be inserted into second central aperture 237 of second central axially extending portion 236 (see FIG. 3). In some embodiments, first central axially extending portion 216 and second central axially extending portion 236 could be configured to snap-fit together. Some other embodiments, not shown, could include additional flanges, tabs, recesses, or other provisions to facilitate such a snap-fit. In other embodiments, first central axially extending portion 216 could be bonded to second central axially extending portion 236. For example, surface 240 of first central axially extending portion 216 could be glued, or otherwise bonded, to surface 242 of second central axially extending portion 236. The assembly of first pulley member 210 and second pulley member 230 leaves first central aperture 217 of first central axially extending portion 216 exposed and open so that another tensioning element (e.g., tensioning element 150 shown in FIG. 1) can be inserted through first central aperture 217.

Together, first central axially extending portion 216 bonded to second central axially extending portion 236 may comprise central shaft 270 that extends between first disc 214 and second disc 234. Moreover, first disc 214, second disc 234, and central shaft 270 may be collectively referred to as a "pulley" in pulley assembly 202. Throughout this detailed description and in the claims, the term "shaft" may be used interchangeably with "axle" or "post." It may be appreciated that in other embodiments, a pulley assembly could comprise a flat disc bonded to another member that includes a disc and a shaft. In other words, in some other embodiments, only one pulley member may include an axially extending shaft, and that shaft could be bonded directly to the inner surface of the corresponding disc. In still other embodiments, each disc and the shaft extending between them could be formed as a single component, by molding, three-dimensional printing, etc. Therefore, a central shaft of a pulley member need not be comprised of two or more distinct components (e.g., first and second central axially extending portions) and could be a single monolithic portion.

Pulley assembly 202 is further seen to include circumferential gap 300. Circumferential gap 300 is a gap that generally extends in a circumferential direction around pulley assembly 202. Specifically, circumferential gap 300 is at least partially open around the entire circumference. Circumferential gap 300 is bounded in opposing axial directions by first disc 214 and second disc 234. In a radial direction toward the center of pulley assembly 202, circumferential gap 300 is bounded by surface 271 of central shaft 270. At some locations, circumferential gap 300 may also be bounded in a radial direction by ring element 250 (i.e., in a radial direction directed away from a center of pulley assembly 202).

Pulley assembly 202 may also comprise circumferential opening 320, which provides access to circumferential gap 300 along the peripheral edge of pulley assembly 202. Because of the presence of ring element 250, circumferential opening 320 may not extend around the entire circumference of pulley assembly 202.

As clearly seen in FIG. 4, circumferential opening 320 may have axial thickness 322 in the axial direction, while circumferential gap 300 may have an axial thickness 302 in the axial direction. In some embodiments, the presence of lips (e.g., first peripheral axially extending portion 218 and second peripheral axially extending portion 238) at the periphery of pulley assembly 202 means axial thickness 322 is less than axial thickness 302.

Ring element 250 may be disposed within circumferential gap 300. Specifically, first retaining portion 252 and second retaining portion 254 may be retained within groove 219 and groove 239 of circumferential gap 300, respectively. Additionally, outer portion 256 of ring element 250 may be sized to fit in the space between first peripheral axially extending portion 218 and second peripheral axially extending portion 238, thereby closing off circumferential opening 320.

First retaining portion 252 and second retaining portion 254 give ring element 250 axial thickness 330 at inward facing surface 258. In at least some embodiments, axial thickness 330 may be approximately similar to axial thickness 302 of circumferential gap. In some cases, axial thickness 330 may be slightly less than axial thickness 302 to make it easier for ring element 250 to slide around within circumferential gap 300. Additionally, axial thickness 330 of inward facing surface 258 is substantially greater than axial thickness 322 of circumferential opening 320. This difference in sizes prevents ring element 250 from passing between first peripheral axially extending portion 218 and second peripheral axially extending portion 238 (i.e., through circumferential opening 320) and so ensures ring element 250 is retained within circumferential gap 300.

As seen in FIG. 4, tensioning element 160 may pass into circumferential gap 300 through circumferential opening 320. Inside circumferential gap 300, tensioning element 160 may be sized to fit into the section of circumferential gap 300 passing between ring element 250 and central shaft 270. Another portion of tensioning element 160 (not visible in FIG. 4) may then pass back out of circumferential gap 300 at a location where ring element 250 does not block circumferential opening 320.

This exemplary configuration allows tensioning element 160 to pass around central shaft 270 of pulley assembly 202 to facilitate translation of tensioning element 160 about pulley assembly 202. The configuration also ensures tensioning element 160 does not fall out of circumferential gap 300 (i.e., fall off of pulley assembly 202) through the use of ring element 250. This arrangement therefore allows for a system where tensioning elements do not become decoupled when there is slack in the system.

In different embodiments, the materials used for one or more elements of a pulley assembly could vary. Exemplary materials that could be used for either a pulley member or ring element include, but are not limited to, plastics, rubber, metal as well as any other materials. In at least one embodiment, each pulley member and the ring element are made of a plastic material. In at least some embodiments, a ring element may be made of a material that has a sufficiently low coefficient of friction with the material of the pulley members to allow the ring element to rotate easily.

Figure 5:
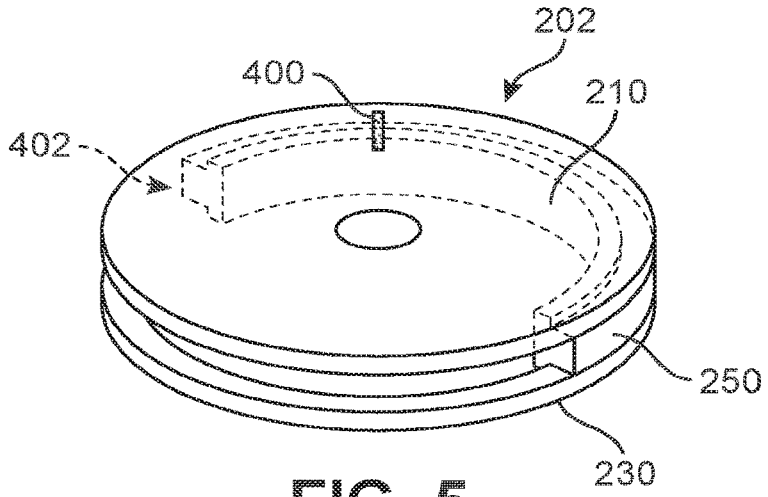
FIG. 5 is a schematic isometric view of an embodiment of a pulley assembly with an internal partial ring element in a first circumferential position.
Figure 6:
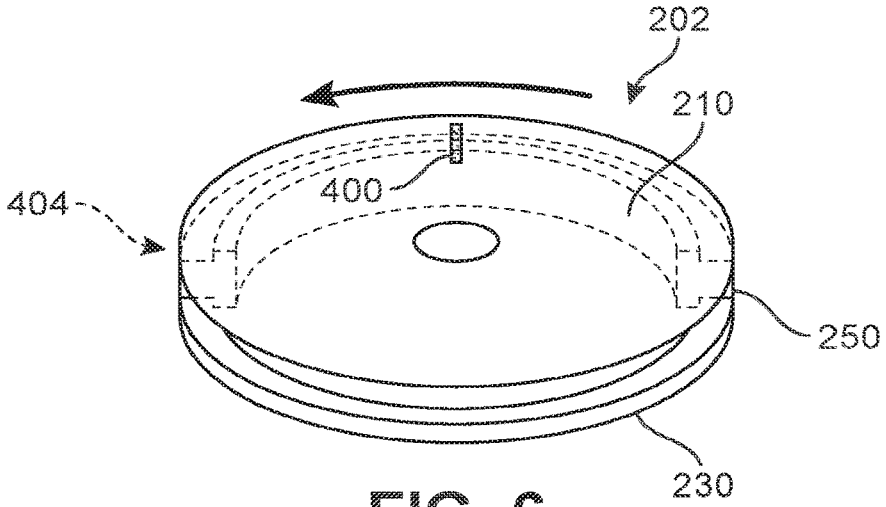
FIG. 6 is a schematic isometric view of an embodiment of the pulley assembly of FIG. 5 with the internal partial ring element in a second circumferential position.
Figure 7:
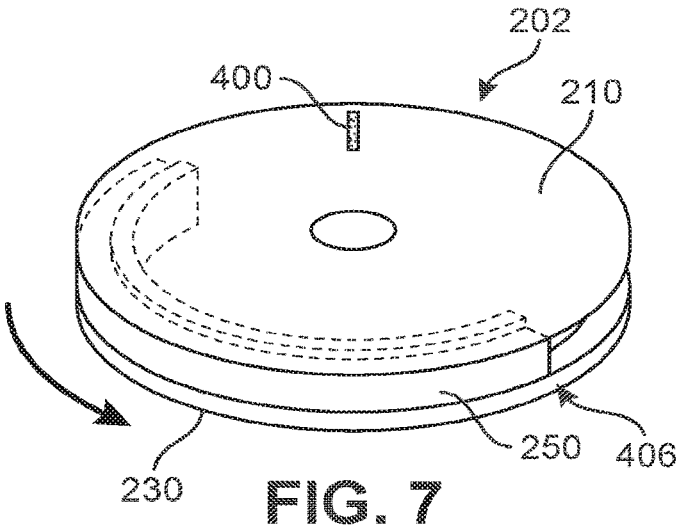
FIG. 7 is a schematic isometric view of an embodiment of the pulley assembly of FIG. 5 with the internal partial ring element in a second circumferential position.

FIGS. 5-7 each illustrate an isometric view of pulley assembly 202 with ring element 250 disposed in different circumferential, or angular, positions relative to first pulley member 210 and second pulley member 230. In each of FIGS. 5-7, first pulley member 210 is associated with mark 400 for purposes of illustration. In particular, viewing the stationary position of mark 400 in FIGS. 5-7 shows that first pulley member 210 and second pulley member 230 are stationary (i.e., do not change positions) from one figure to another.

As previously discussed, ring element 250 can translate in a circumferential direction around pulley assembly 202. FIG. 5 shows ring element 250 in first circumferential position 402. In FIG. 6, ring element 250 has been rotated in a counterclockwise direction through circumferential gap 300 (see FIG. 4) to second circumferential position 404, while first pulley member 210 and second pulley member 230 remain in place (i.e., do not rotate). Furthermore, as shown in FIG. 7, ring element 250 may continue to rotate all the way around pulley assembly 202 to third circumferential position 406 and may eventually return to the initial position shown in FIG. 5.

Because ring element 250 is able to rotate, ring element 250 may be repositioned in response to changing forces during fastening of an article or during use. This provision may be especially important in situations where the pulley assembly itself cannot rotate, or where the rotation may not be easily controlled, relative to another tensioning element, fastener, or portion of an upper.

Figure 8:
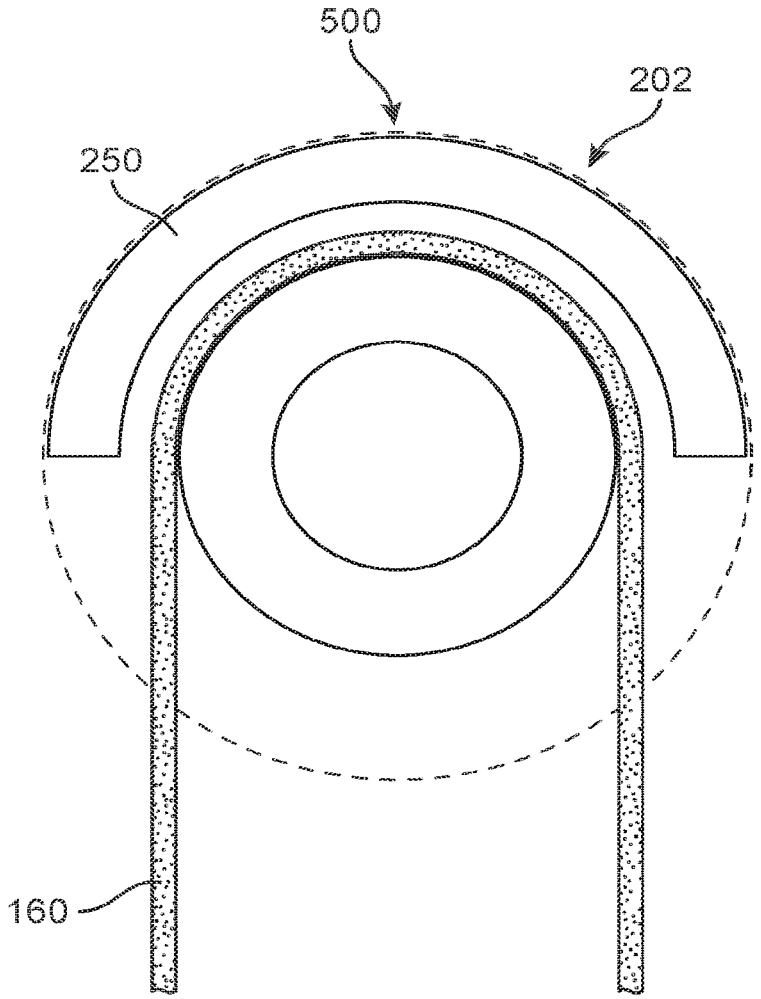
FIG. 8 is a schematic side view of an embodiment of some components of a pulley assembly having an internal partial ring element that can move.
Figure 9:
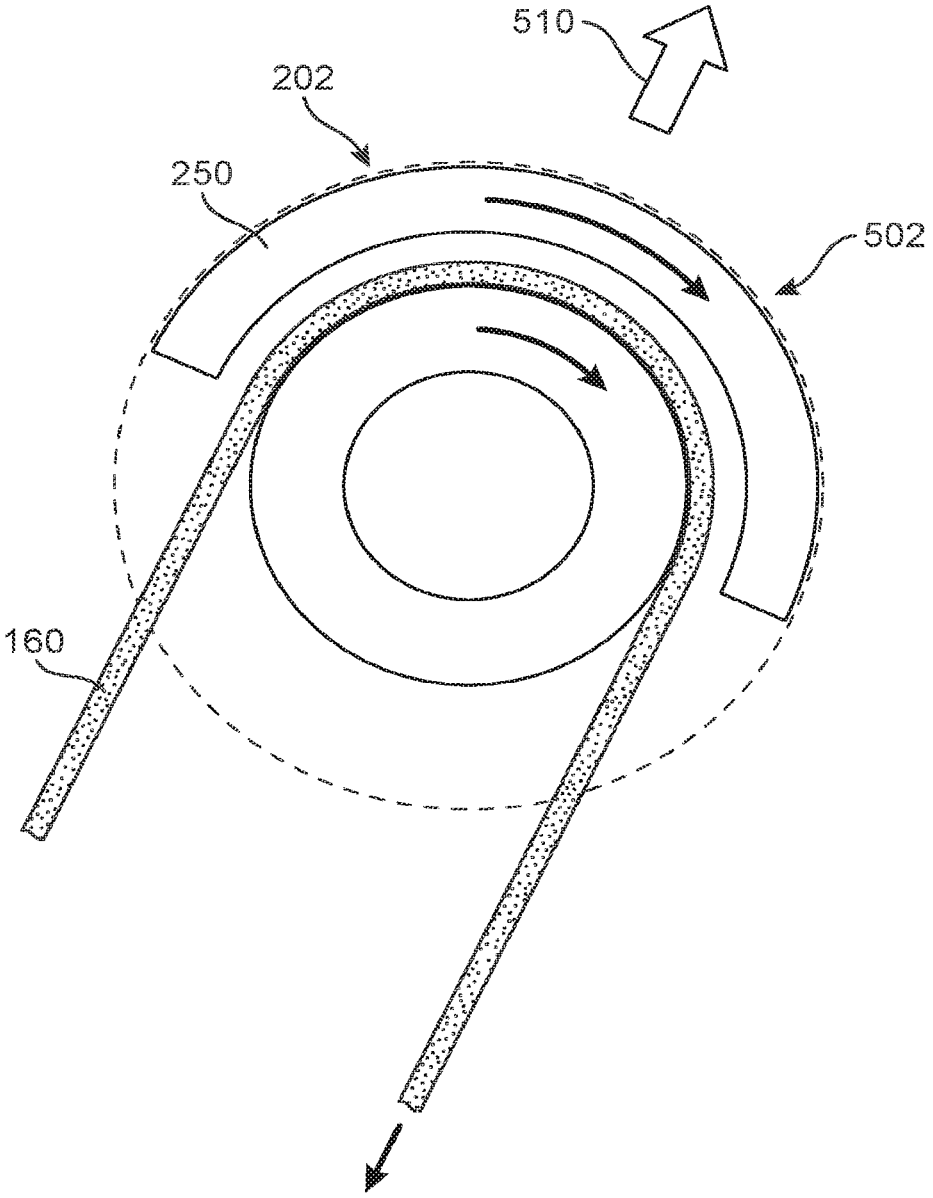
FIG. 9 is a schematic side view of the pulley assembly of FIG. 8 in which the internal partial ring element rotates in the circumferential direction as the pulley assembly is pulled toward a different position.

FIGS. 8-9 illustrate a sequence of schematic views of some components of a dynamic tensioning system during operation, according to an embodiment. In FIG. 8, pulley assembly 202 (only some components are visible for purposes of clarity) may be in a neutral position. In this position, ring element 250 may be disposed at first circumferential position 500 that is positioned for segments of tensioning element 160 to pass straight from pulley assembly 202 toward attachment locations on an article (not shown). In FIG. 9, force 510 is applied (e.g., by a lace or other element extending through a central aperture of pulley assembly 202) and may pull pulley assembly 202 to a new position. Because ring element 250 can rotate, ring element 250 may move to second circumferential position 502 that also allows segments of tensioning element 160 (now oriented in a new direction because of the adjusted position of pulley assembly 202) to pass straight from pulley assembly 202 toward attachment locations on the article.

Figure 10:
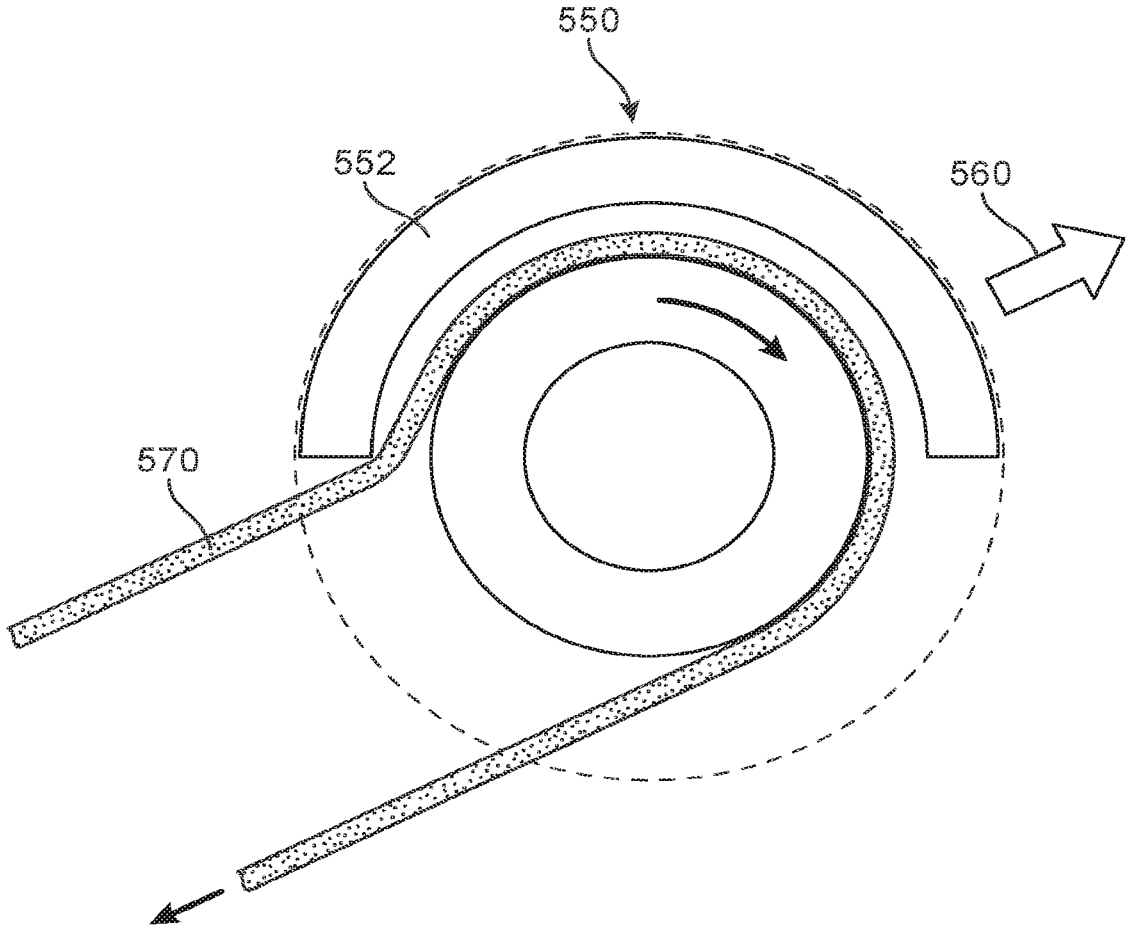
FIG. 10 is a schematic side view of another embodiment of some components of a pulley assembly.

To better understand the utility of the configuration shown in FIGS. 8-9, another embodiment is depicted in FIG. 10. In FIG. 10, pulley assembly 550 includes ring element 552 that has a fixed circumferential position relative to the pulley discs of pulley assembly 550. Therefore, as force 560 is applied to move pulley assembly 550, ring element 552 cannot move to a different circumferential position and therefore may impede tensioning element 570 in taking a straight path to nearby attachment points. This may reduce the ability of a tensioning system to dynamically adjust loads across an article.

Embodiments can include provisions that limit pinching or squeezing of pulley discs in a pulley assembly during use. In embodiments where the discs of a pulley assembly may tend to be squeezed together under the application of axial forces, such provisions could include an additional structure that helps reduce such squeezing. In some embodiments, an external ring element (or outer ring element) could be used to counter any axial forces at the outer perimeter of the pulley assembly.

Figure 13:
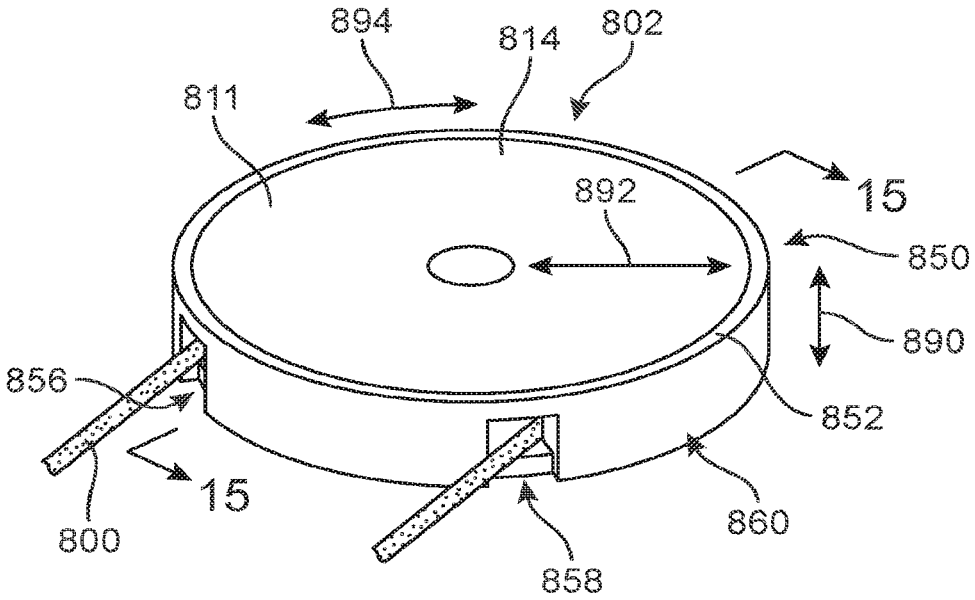
FIG. 13 is a schematic isometric view of an embodiment of a pulley assembly including an external ring element.
Figure 14:
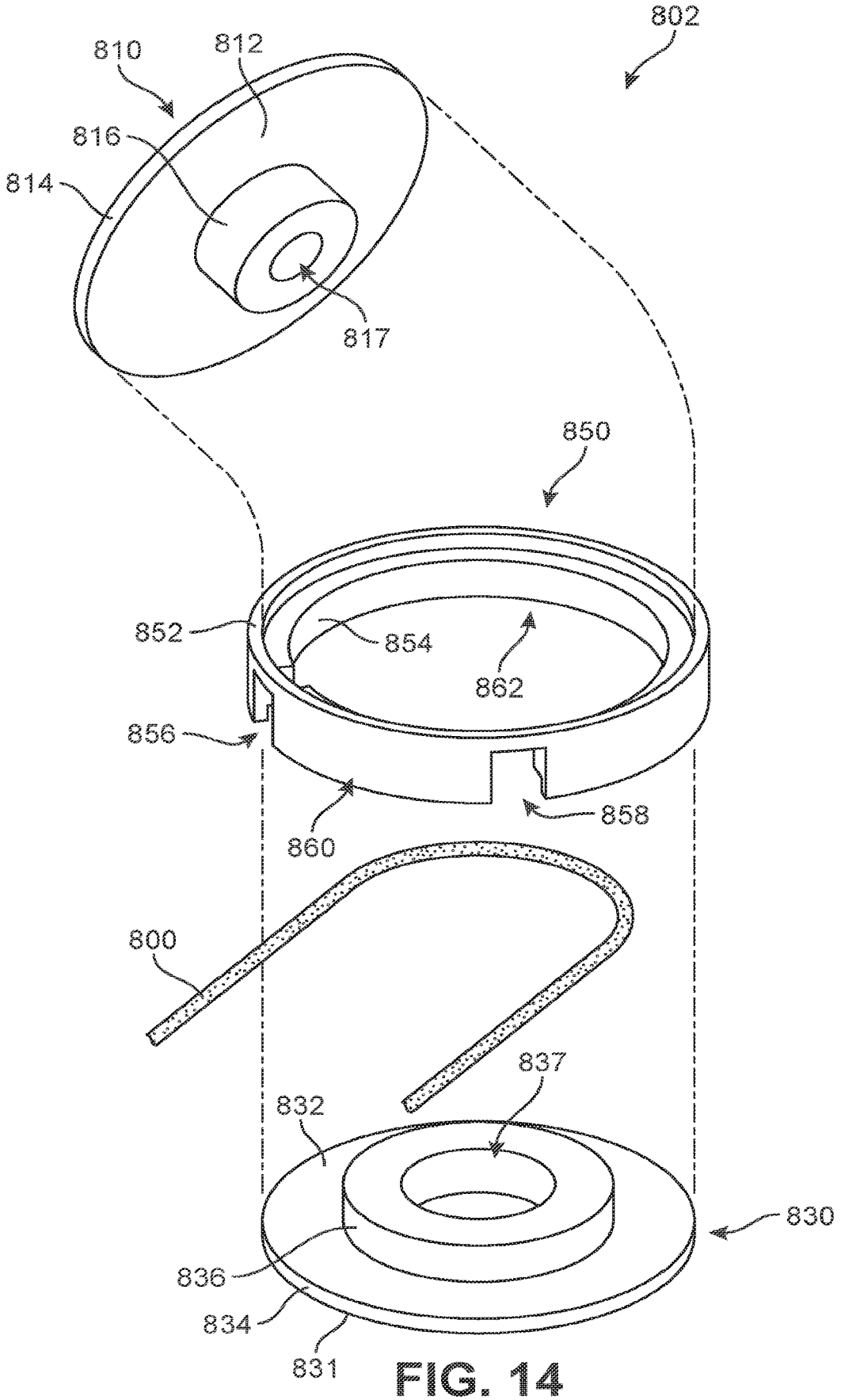
FIG. 14 is a schematic exploded view of the pulley assembly of FIG. 13.

FIG. 13 is an isometric view of an embodiment of pulley assembly 802 as well as portions of tensioning element 800. FIG. 14 is an exploded isometric view of the components shown in FIG. 13.

Referring to FIG. 13, pulley assembly 802 may be associated with set of axial directions 890 (or simply axial directions 890), set of radial directions 892 (or simply radial directions 892), and set of circumferential directions 894 (circumferential directions 894). Thus, axial directions 890 may coincide with the thickness of pulley assembly 802, while radial directions 892 are associated with the radius of pulley assembly 802. Circumferential directions 894 are associated with the circumference of the pulley, or the angular positions around the pulley.

Referring to FIGS. 13-14, pulley assembly 802 is comprised of a pair of discs and an external ring element that helps to prevent tensioning element 800 from falling off of pulley assembly 802 during use. Pulley assembly 802 may include first pulley member 810 and second pulley member 830. First pulley member 810 includes outer side 811 and inner side 812. First pulley member 810 may also be comprised of first disc 814 and first central axially extending portion 816. As seen in FIG. 12, first central axially extending portion 816 extends from inner side 812, while outer side 811 has a generally flat surface (see FIG. 13).

In different embodiments, the geometry of first pulley member 810 could vary. First disc 814 may have a generally rounded or circular shape. First central axially extending portion 816 may have a cylindrical shape. Furthermore, first central axially extending portion 816 may include first central aperture 817.

Second pulley member 830 includes outer side 831 and inner side 832. Second pulley member 830 may also be comprised of second disc 834 and second central axially extending portion 836. As seen in FIG. 14, second central axially extending portion 836 extends from inner side 832, while outer side 831 has a generally flat surface that is similar to outer side 811 of first pulley member 810.

In different embodiments, the geometry of second pulley member 830 could vary. Second disc 834 may have a generally rounded or circular shape. Second central axially extending portion 836 may have a cylindrical shape. Furthermore, second central axially extending portion 836 may include second central aperture 837.

Pulley assembly 802 may also include external ring element 850, which is also referred to simply as ring element 850. Ring element 850 includes outer covering portion 852 and inner retaining portion 854. Ring element 850 further includes outer surface 860 and inner surface 862.

In order to provide entry of a tensioning element into the pulley assembly, an external ring element can include one or more circumferential openings. In the embodiment of FIGS. 13-14, ring element 850 may include first circumferential opening 856 and second circumferential opening 858. Both first circumferential opening 856 and second circumferential opening 858 may extend through ring element 850 from outer surface 860 to inner surface 862.

While the embodiment of FIGS. 13-14 includes an external ring element that forms a complete ring (i.e., the ring is closed with no ends), other embodiments could use a partial external ring element. In such an embodiment, the partial ring element may not extend around the full circumference of a pulley assembly and instead could include a gap between two ends of the partial ring. It may be appreciated that such a gap would have to be small enough so that the central shaft of the pulley assembly could not pass through the gap, thereby separating the pulley assembly and the partial external ring element. In such an embodiment it may also be necessary to ensure that the ring element is sufficiently rigid so that the central shaft could not be forced through the gap.

In different embodiments, the cross-sectional geometry of ring element 850 could vary. Some embodiments could utilize a rounded or circular cross section. In the embodiment shown in FIGS. 13-14, ring element 850 has a T-like cross-sectional shape due to the configuration of outer covering portion 852 and inner retaining portion 854. Moreover, the cross-sectional shape of ring element 850 (taken through a plane that is perpendicular to the circumferential direction) is approximately constant along the length of ring element 850.

Figure 15:
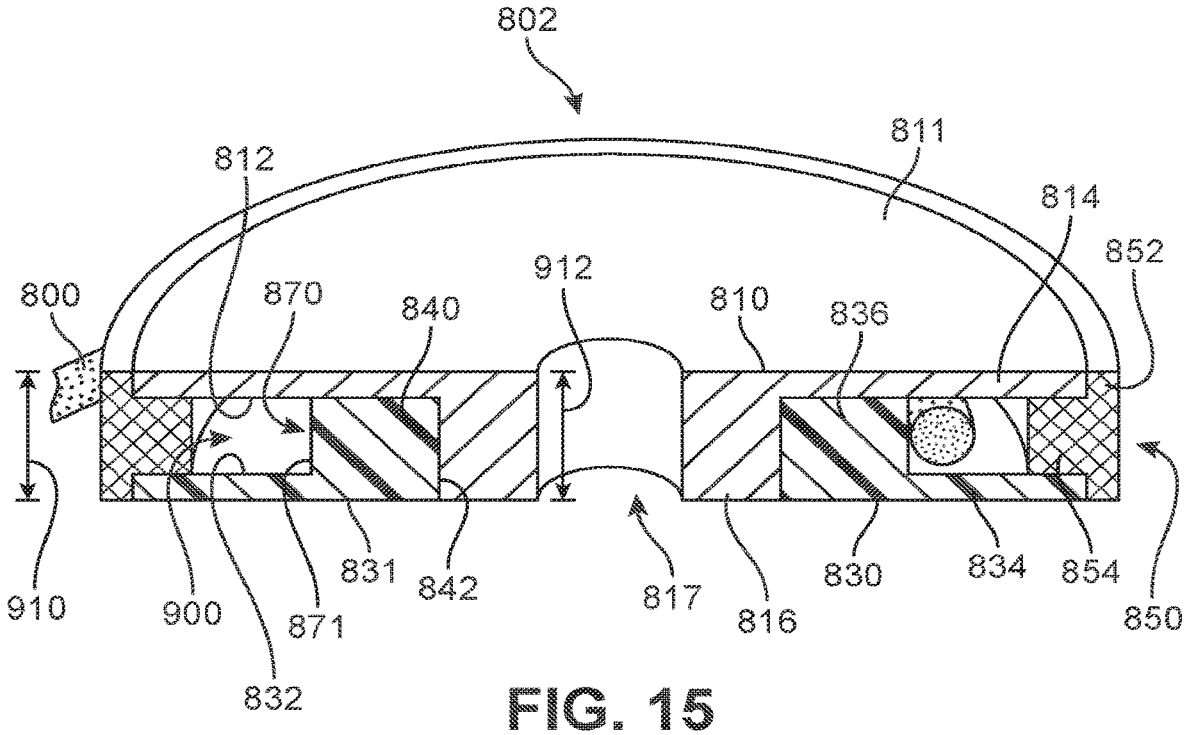
FIG. 15 is a schematic cut-away view of the pulley assembly of FIG. 13.

FIG. 15 is a cross-sectional view of pulley assembly 802, as indicated in the view of FIG. 13. Referring to FIG. 15, first pulley member 810 may be permanently attached or joined with second pulley member 830. Specifically, first central axially extending portion 816 of first pulley member 810 may be inserted into second central aperture 837 of second central axially extending portion 836 (see FIG. 14). In some embodiments, first central axially extending portion 816 and second central axially extending portion 836 could be configured to snap-fit together. Some other embodiments, not shown, could include additional flanges, tabs, recesses, or other provisions to facilitate such a snap-fit. In other embodiments, first central axially extending portion 816 could be bonded to second central axially extending portion 836. For example, surface 840 of first central axially extending portion 816 could be glued, or otherwise bonded, to surface 842 of second central axially extending portion 836. The assembly of first pulley member 810 and second pulley member 830 leaves first central aperture 817 of first central axially extending portion 816 exposed and open so that another tensioning element (e.g., tensioning element 800 shown in FIG. 13) can be inserted through first central aperture 817.

Together, first central axially extending portion 816 bonded to second central axially extending portion 836 may comprise central shaft 870 that extends between first disc 814 and second disc 834. Moreover, first disc 814, second disc 834, and central shaft 870 may be collectively referred to as a "pulley" in pulley assembly 802. It may be appreciated that, in other embodiments, a pulley assembly could comprise a flat disc bonded to another member that includes a disc and a shaft. In other words, in some other embodiments, only one pulley member may include an axially extending shaft, and that shaft could be bonded directly to the inner surface of the corresponding disc. In still other embodiments, each disc and the shaft extending between them could be formed as a single component, by molding, three-dimensional printing, etc. Therefore, a central shaft of a pulley member need not be comprised of two or more distinct components (e.g., first and second central axially extending portions) and could be a single monolithic portion.

Pulley assembly 802 is further seen to include circumferential gap 900. Circumferential gap 900 is a gap that generally extends in a circumferential direction around pulley assembly 802. Specifically, circumferential gap 900 is at least partially open around the entire circumference. Circumferential gap 900 is bounded in opposing axial directions by first disc 814 and second disc 834. In a radial direction toward the center of pulley assembly 802, circumferential gap 900 is bounded by surface 871 of central shaft 870. Circumferential gap 900 may also be bounded in a radial direction by ring element 850 (i.e., in a radial direction directed away from a center of pulley assembly 802). As previously discussed, first circumferential opening 856 and second circumferential opening 858 may provide access to circumferential gap 900 (see FIG. 13).

Ring element 850 is mounted to first pulley member 810 and second pulley member 830, and disposed adjacent to circumferential gap 900. Outer covering portion 852 of ring element 850 may surround and cover circumferential gap 900. Moreover, as seen in FIG. 15, inner retaining portion 854 of ring element 850 may be received within a part of circumferential gap 900. This configuration prevents any axial movement of ring element 850 relative to first pulley member 810 and second pulley member 830. Moreover, because ring element 850 is closed (i.e., a loop), ring element 850 may not expand radially so long as a sufficiently rigid material is chosen, thereby preventing inner retaining portion 854 from escaping from circumferential gap 900 in a radial direction. In some embodiments, inner retaining portion 854 is not fixed, or directly attached to first pulley member 810 or second pulley member 830 and instead can slide or translate around circumferential gap 900 (in the circumferential direction).

As seen in FIG. 15, tensioning element 800 may pass into circumferential gap 900 through one of first circumferential opening 856 or second circumferential opening 858 (see FIG. 13). Inside circumferential gap 900, tensioning element 800 may be sized to fit into the section of circumferential gap 900 passing between ring element 850 and central shaft 870. Another portion of tensioning element 800 (not visible in FIG. 15) may then pass back out of circumferential gap 900 at one of first circumferential opening 856 or second circumferential opening 858.

This exemplary configuration allows tensioning element 800 to pass around central shaft 870 of pulley assembly 802 to facilitate translation of tensioning element 800 about pulley assembly 802. The configuration also ensures tensioning element 800 does not fall out of circumferential gap 900 (i.e., fall off the pulley assembly) through the use of ring element 850. This arrangement therefore allows for a system where tensioning elements do not become decoupled when there is slack in the system.

In different embodiments, the axial dimensions of a component or collection of components in a pulley assembly could vary. Referring to FIG. 15, outer covering portion 852 of ring element 850 has axial thickness 910. Additionally, the axial distance spanned between outer side 811 of first pulley member 810 and outer side 831 of second pulley member 830 is equal to axial thickness 912. That is, the axial thickness of the pulley, which comprises first disc 814, second disc 834, and central shaft 870, is equal to axial thickness 912. In the embodiment of FIG. 15, axial thickness 910 is approximately equal to axial thickness 912. In some other embodiments, an external ring element could have an axial thickness that is greater than the axial thickness spanned by the outer surfaces of two pulley members.

Figure 16:
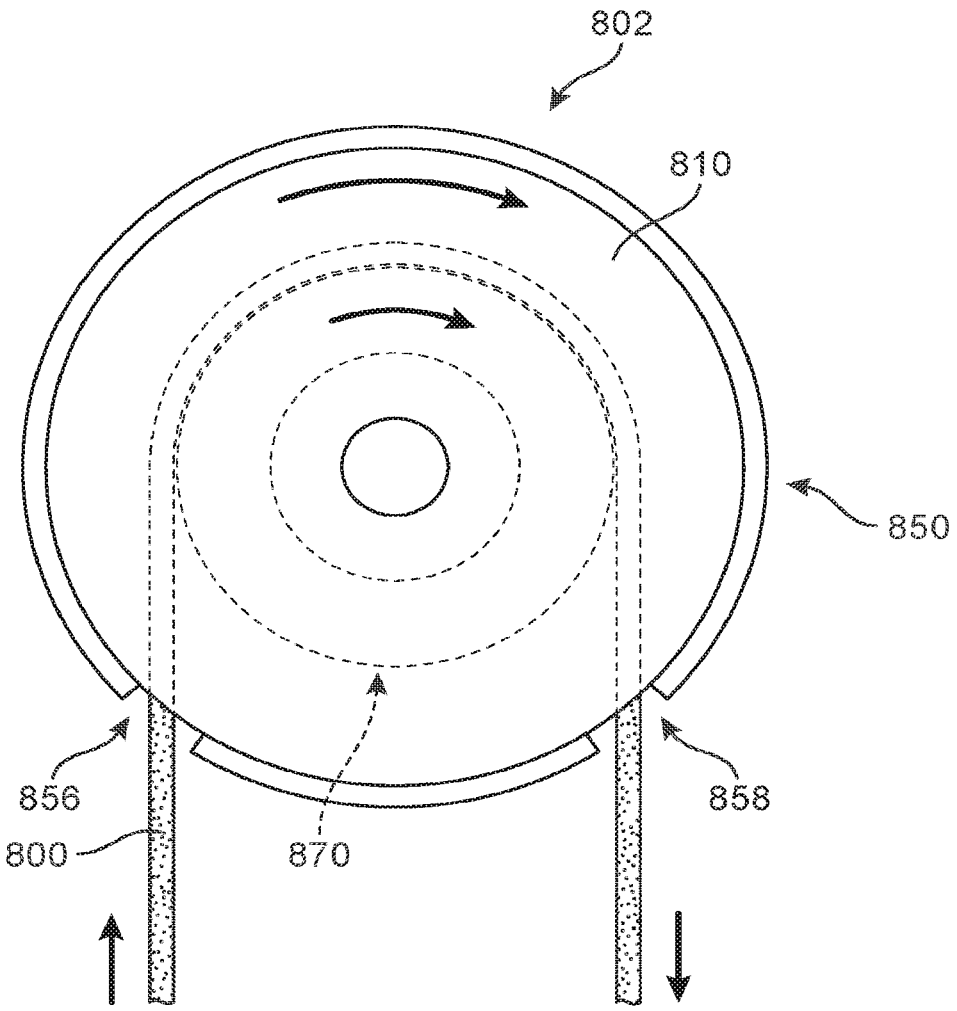
FIG. 16 is a schematic view of an embodiment of a pulley assembly.

FIG. 16 is a schematic view of an embodiment of pulley assembly 802 and tensioning element 800, which is intended to illustrate the general operation of the components. Referring to FIG. 16, tensioning element 800 can pass in and out of first circumferential opening 856 and second circumferential opening 858. In some situations, as tensioning element 800 passes around central shaft 870, first pulley member 810 and second pulley member 830 (see FIG. 15) may rotate slightly with tensioning element 800 (for example, due to slight amounts of friction between tensioning element 800 and central shaft 870). The coupling between ring element 850 and the pulley members allows ring element 850 to stay approximately stationary (i.e., rotationally stationary) since inner retaining portion 854 (see FIG. 15) of ring element 850 can slide through circumferential gap 900. This allows the circumferential openings in ring element 850 to remain in position to receive segments of tensioning element 800.

Figure 17:
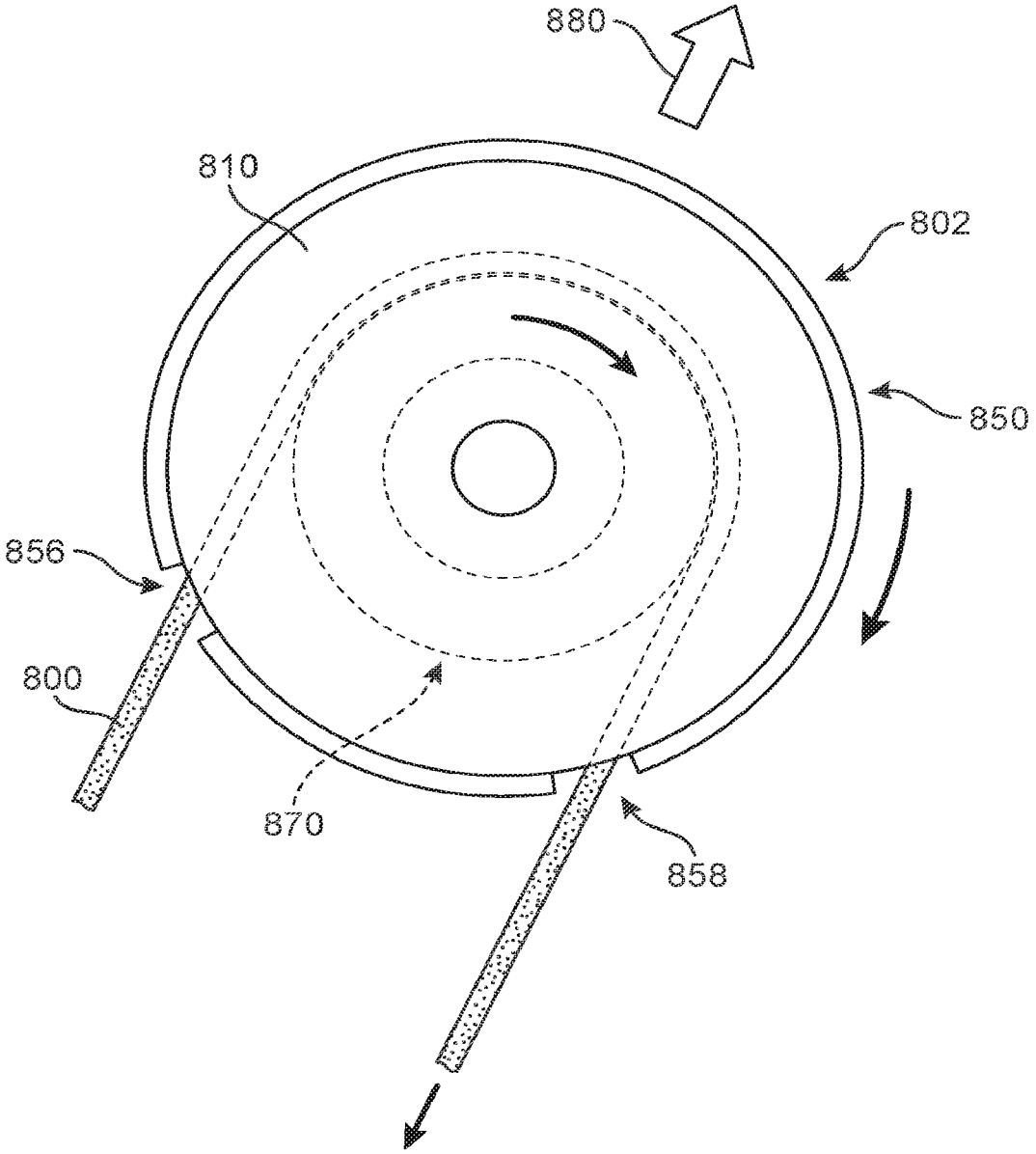
FIG. 17 is a schematic view of the pulley assembly of FIG. 16 in which the external ring element rotates in the circumferential direction as the pulley assembly is pulled toward a different position.
Figure 18:
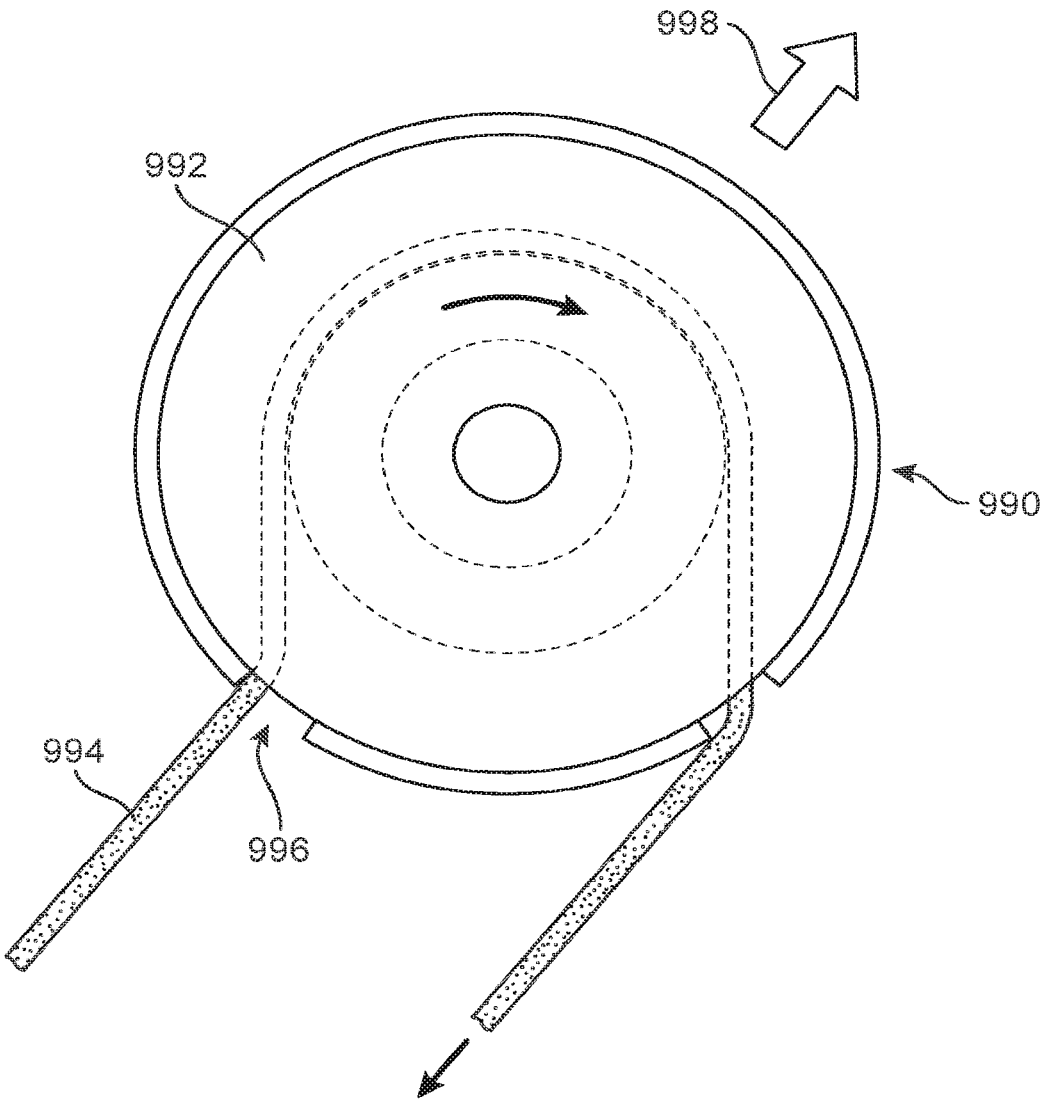
FIG. 18 is a schematic view of another embodiment of some components of a pulley assembly.

This relative rotation between ring element 850 and the pulley members also allows the orientation at which the strands approach pulley assembly 802 to vary in a similar manner to the situation shown for pulley assembly 202 in FIGS. 8-9. For example, FIG. 17 shows a configuration where pulley assembly 802 has been pulled to a new position that requires tensioning element segments to pass in a modified orientation in order to achieve the straightest path toward anchor points (not shown). As seen in FIG. 17, ring element 850 rotates in the circumferential direction to allow tensioning element segments to travel without any kinks. In contrast, in an alternative embodiment depicted in FIG. 18, external ring element 990 is rotationally fixed relative to pulley 992. This results in a situation where part of tensioning element 994 must turn sharply out of pulley 992 (due to the fixed orientation of circumferential gaps 996) before traveling toward anchor points when force 998 acts to pull the assembly in a new direction.

Figure 19:
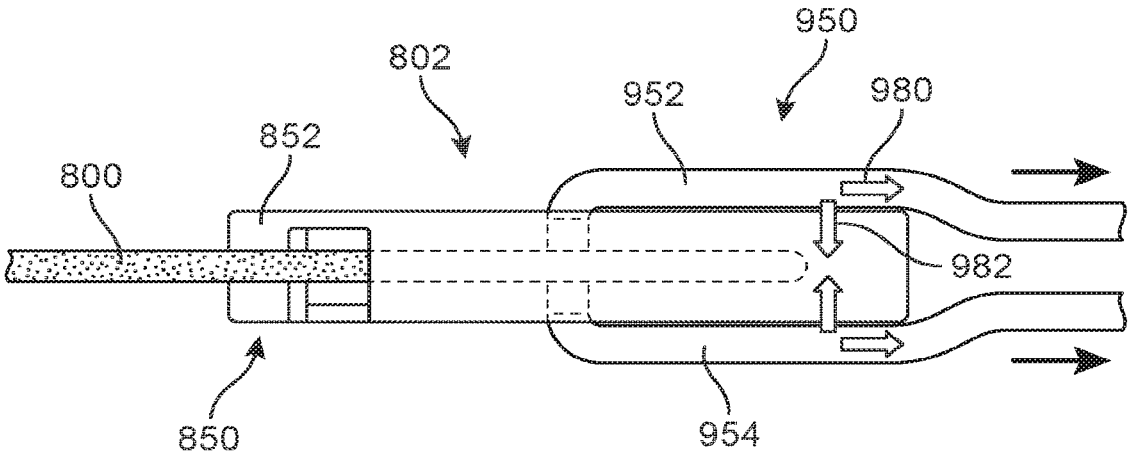
FIG. 19 is a side schematic view of an embodiment of a pulley assembly undergoing stresses applied by a tensioning element that passes through a central aperture of the pulley assembly.

FIG. 19 illustrates a schematic side view of an embodiment of pulley assembly 802, tensioning element 800, and tensioning element 950. Referring to FIG. 19, tensioning element 950 passes through a central aperture in pulley assembly 802, with first segment 952 and second segment 954 extending across opposing sides of pulley assembly 802. In the configuration of FIG. 19, tensioning element 950 has been pulled taut and this results in both radially directed force components 980 (along the length of the segments) as well as axially directed force components 982 due to the separation of first segment 952 and second segment 954 in the axial direction. In the embodiment shown in FIG. 19, outer covering portion 852 of ring element 850 remains substantially rigid and prevents any squeezing of opposing sides of pulley assembly 802 from axially directed force components 982.

Figure 20:
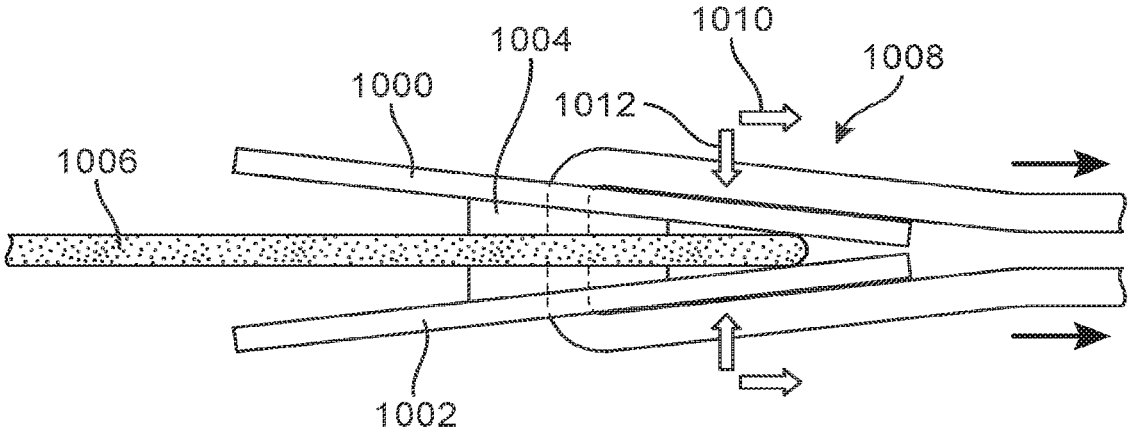
FIG. 20 is a side schematic view of another embodiment of a pulley undergoing stresses applied by a tensioning element that passes through a central aperture of the pulley.

FIG. 20 illustrates an alternative configuration without an external (or internal) ring element. Referring to FIG. 20, first disc 1000 and second disc 1002 are connected by central shaft 1004. Tensioning element 1006 wraps around central shaft 1004, while tensioning element 1008 passes through an aperture in central shaft 1004. In this embodiment, applying tension along tensioning element 1008 provides both radially directed components of force 1010 and axially directed components of force 1012. However, in contrast to the embodiment shown in FIG. 19, the configuration of FIG. 20 results in a pinching of tensioning element 1006 between first disc 1000 and second disc 1002. This may occur because of the resiliency of the components of the pulley and the tendency of the discs to pivot about central shaft 1004. The resulting pinching may interfere with the motion of tensioning element 1006, increasing friction in the system, and may also increase the rate of wear on elements of the pulley.

Other structures for a pulley assembly with an external ring element are also possible in other embodiments. In one other embodiment, for example, a pulley assembly could include an integral external ring and pulley member (including a disc and a central axially extending portion).

Figure 21:
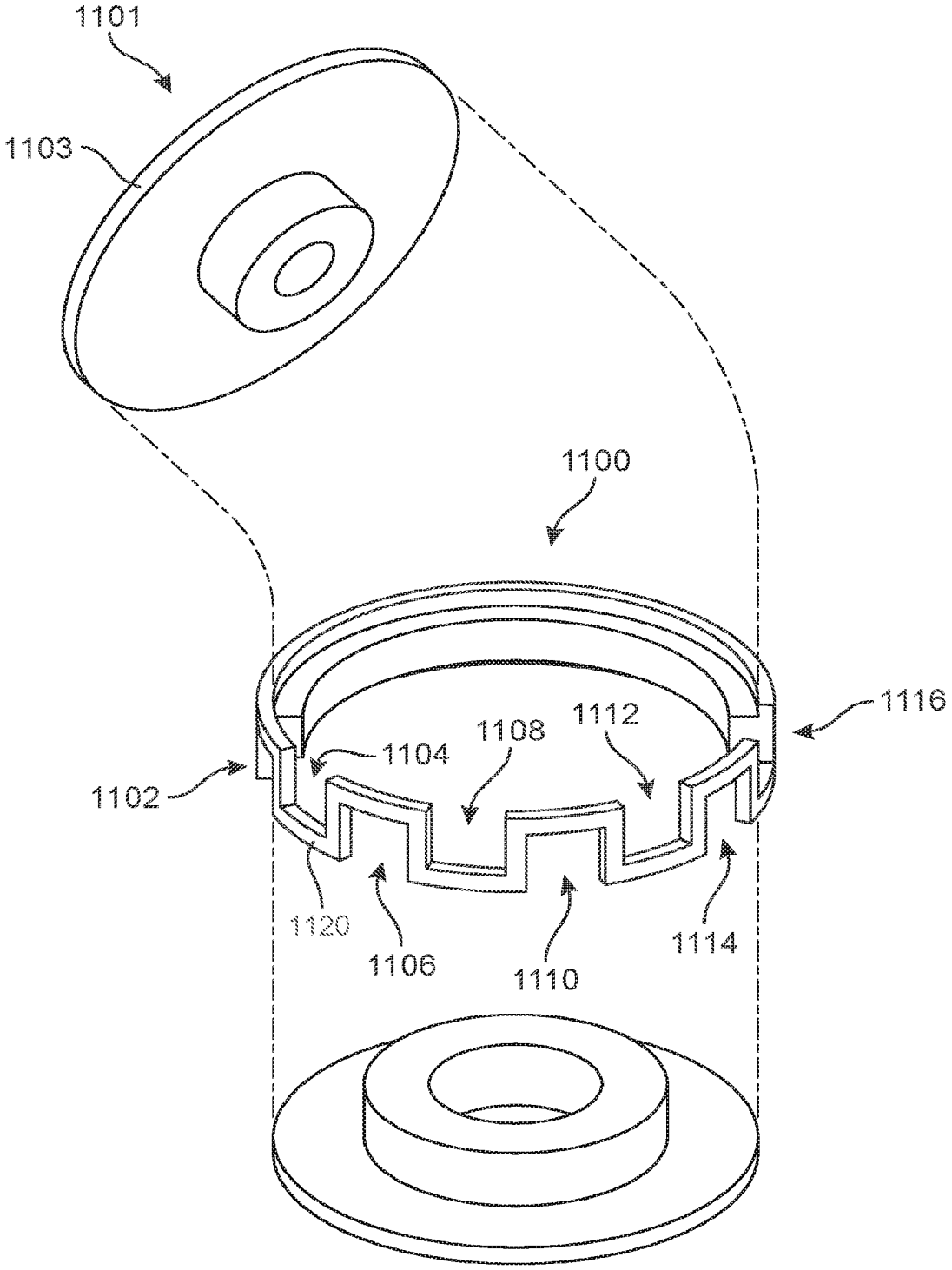
FIG. 21 is a schematic isometric view of another embodiment of an external ring element.

FIG. 21 is a schematic isometric view of another embodiment of external ring element 1100. For context, external ring element 1100 is shown with opposing pulley members 1103 that together with external ring element 1100, comprise pulley assembly 1101. External ring element 1100 may share similar features to ring element 850 shown in FIGS. 13-20 and discussed above. However, rather than having only two circumferential openings, external ring element 1100 includes a plurality of circumferential openings, including first circumferential opening 1102, second circumferential opening 1104, third circumferential opening 1106, fourth circumferential opening 1108, fifth circumferential opening 1110, sixth circumferential opening 1112, seventh circumferential opening 1114 and eighth circumferential opening 1116.

As seen in FIG. 21, the circumferential openings are formed by framing portion 1120 that traverses in alternating axial directions at regular intervals along the circumferential direction. Thus, with respect to external ring element 1100, each circumferential opening is open (not bounded) on one side that is either an upper axial side or a lower axial side.

Figure 22:
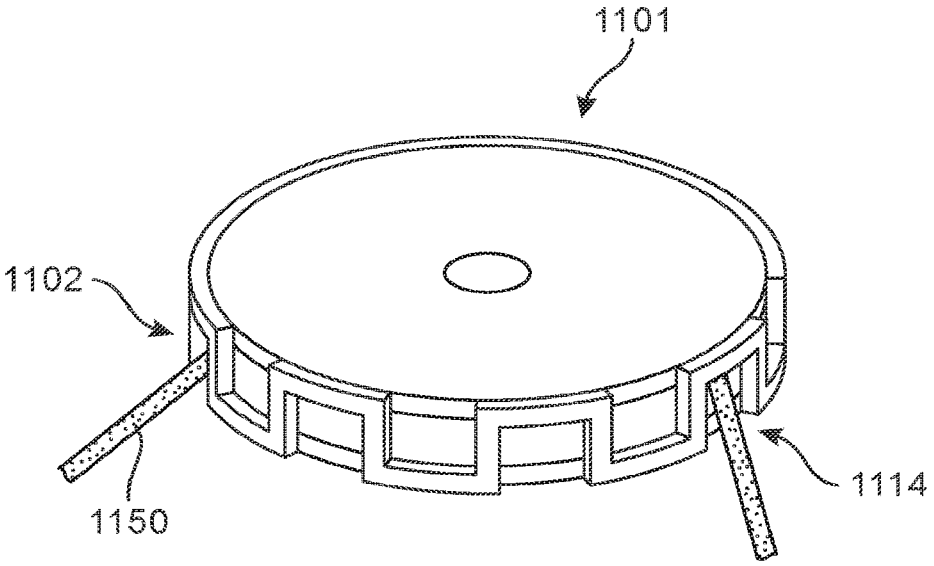
FIG. 22 is a schematic view of the external ring element of FIG. 21 with a tensioning element in a first configuration.
Figure 23:
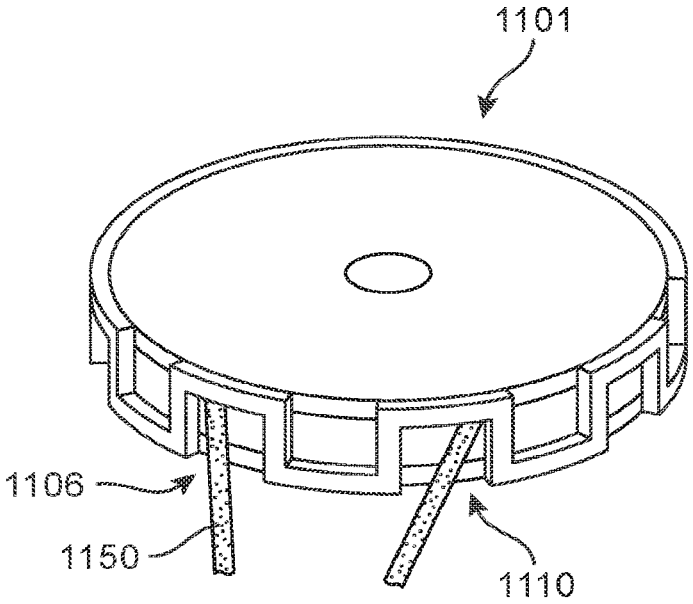
FIG. 23 is a schematic view of the external ring element of FIG. 21 with a tensioning element in a second configuration.

Using a ring element with more than two circumferential openings may allow for multiple arrangements of tensioning elements through a pulley assembly. For example, FIG. 22 is a schematic isometric view of an embodiment of pulley assembly 1101 in which tensioning element 1150 is inserted through first circumferential opening 1102 and exits through seventh circumferential opening 1114. As another example, FIG. 23 is a schematic isometric view of an embodiment of pulley assembly 1101 in which tensioning element 1150 passes through third circumferential opening 1106 and fifth circumferential opening 1110. Different arrangements may be used for different tensioning arrangements, according to whether, for example, the ends of the tensioning element are spread apart on an article (as in FIG. 22) or the ends of the tensioning element may run closer together near the pulley assembly (as in FIG. 23).

Figure 24:
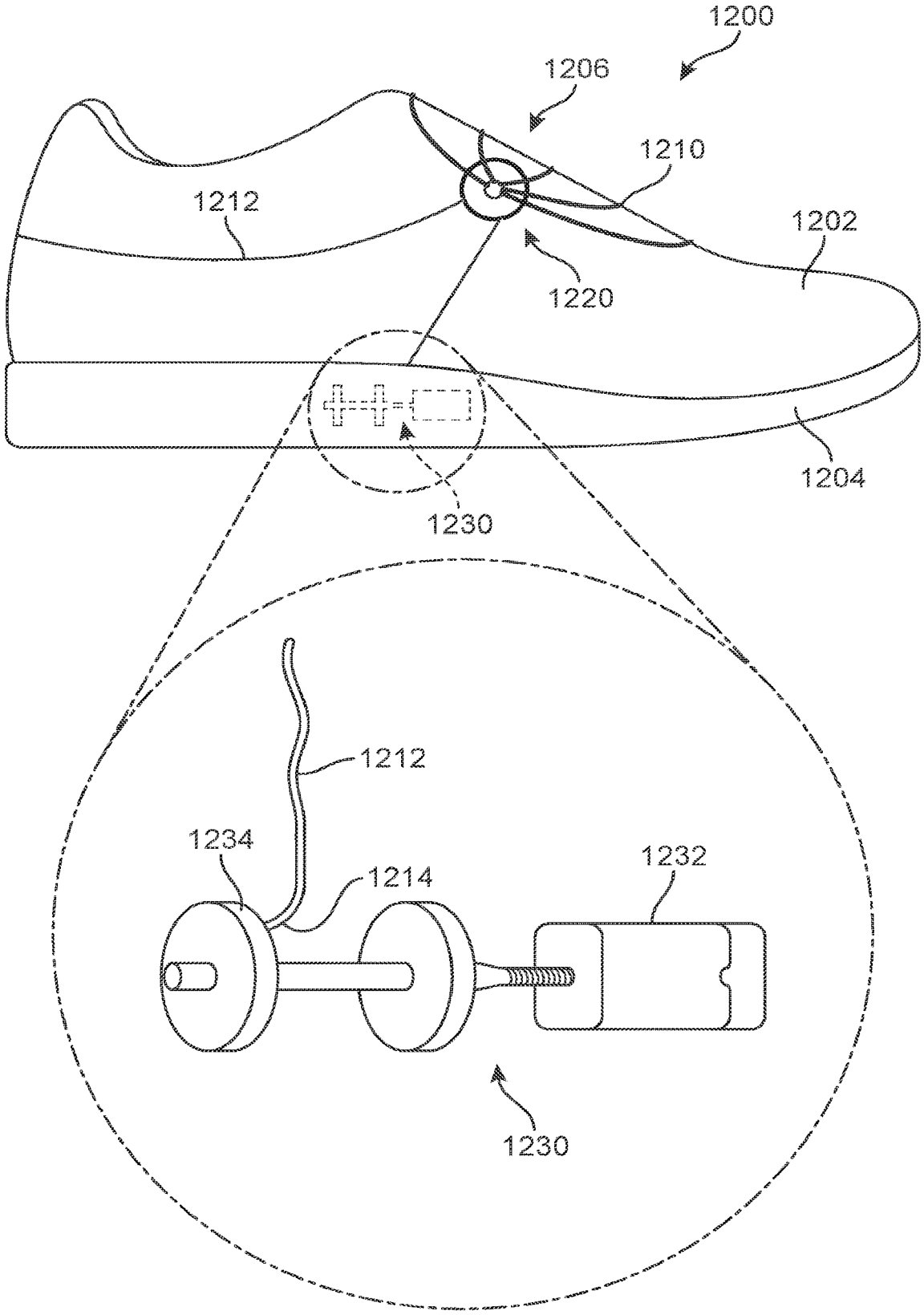
FIG. 24 is a schematic side view of an embodiment of an article of footwear with a dynamic tensioning system.

FIG. 24 illustrates a schematic view of an embodiment of article of footwear 1200, or simply article 1200, (including upper 1202 and sole structure 1204) with dynamic tensioning system 1206.

Embodiments can include various provisions in a tensioning system, including various motorized or automatic tensioning provisions. Embodiments of dynamic tensioning system 1206 may include any suitable tensioning system, including incorporating any of the systems disclosed in one or more of Beers et al., U.S. Patent Application Publication Number 2014/0068838, now U.S. application Ser. No. 14/014,491, filed Aug. 20, 2013 and titled "Motorized Tensioning System"; Beers, U.S. Patent Application Publication Number 2014/0070042, now U.S. application Ser. No. 14/014,555, filed Aug. 20, 2013 and titled "Motorized Tensioning System with Sensors"; and Beers, U.S. Patent Application Publication Number 2014/0082963, now U.S. application Ser. No. 14/032,524, filed Sep. 20, 2013 and titled "Footwear Having Removable Motorized Adjustment System"; which applications are hereby incorporated by reference in their entirety (collectively referred to herein as the "Automatic Lacing cases").

Article 1200 includes one or more tensioning cables 1210 for tightening an instep of article 1200, tensioning cable 1212 for applying tension across side and heel regions of article 1200 and pulley assembly 1220 for dynamically coupling tensioning cables 1210 and tensioning cable 1212. Moreover, article 1200 includes tensioning device 1230, of which some components are schematically shown in the enlarged view in FIG. 24.

In some embodiments, tensioning device 1230 includes motor 1232 and spool 1234. In some embodiments, motor 1232 could include an electric motor. However, in other embodiments, motor 1232 could comprise any kind of non-electric motor known in the art. Examples of different motors that can be used include, but are not limited to, DC motors (such as permanent-magnet motors, brushed DC motors, brushless DC motors, switched reluctance motors, etc.), AC motors (such as motors with sliding rotors, synchronous electrical motors, asynchronous electrical motors, induction motors, etc.), universal motors, stepper motors, piezoelectric motors, as well as any other kinds of motors known in the art.

Motor 1232 may be coupled to spool 1234 using a crankshaft. In some embodiments, other provisions, including a gear system, could be used to transmit torque between motor 1232 (or a crankshaft coupled to motor 1232) and spool 1234.

In some embodiments, a separate power source (not shown) may also be included. A power source may include a battery and/or control unit (not shown) configured to power and control motor 1232. A power source may be any suitable battery of one or more types of battery technologies that could be used to power motor 1232. One possible battery technology that could be used is a lithium polymer battery. The battery (or batteries) could be rechargeable or replaceable units packaged as flat, cylindrical, or coin shaped. In addition, batteries could be single cell or cells in series or parallel. Other suitable batteries and/or power sources may be used for powering motor 1232.

Figure 25:
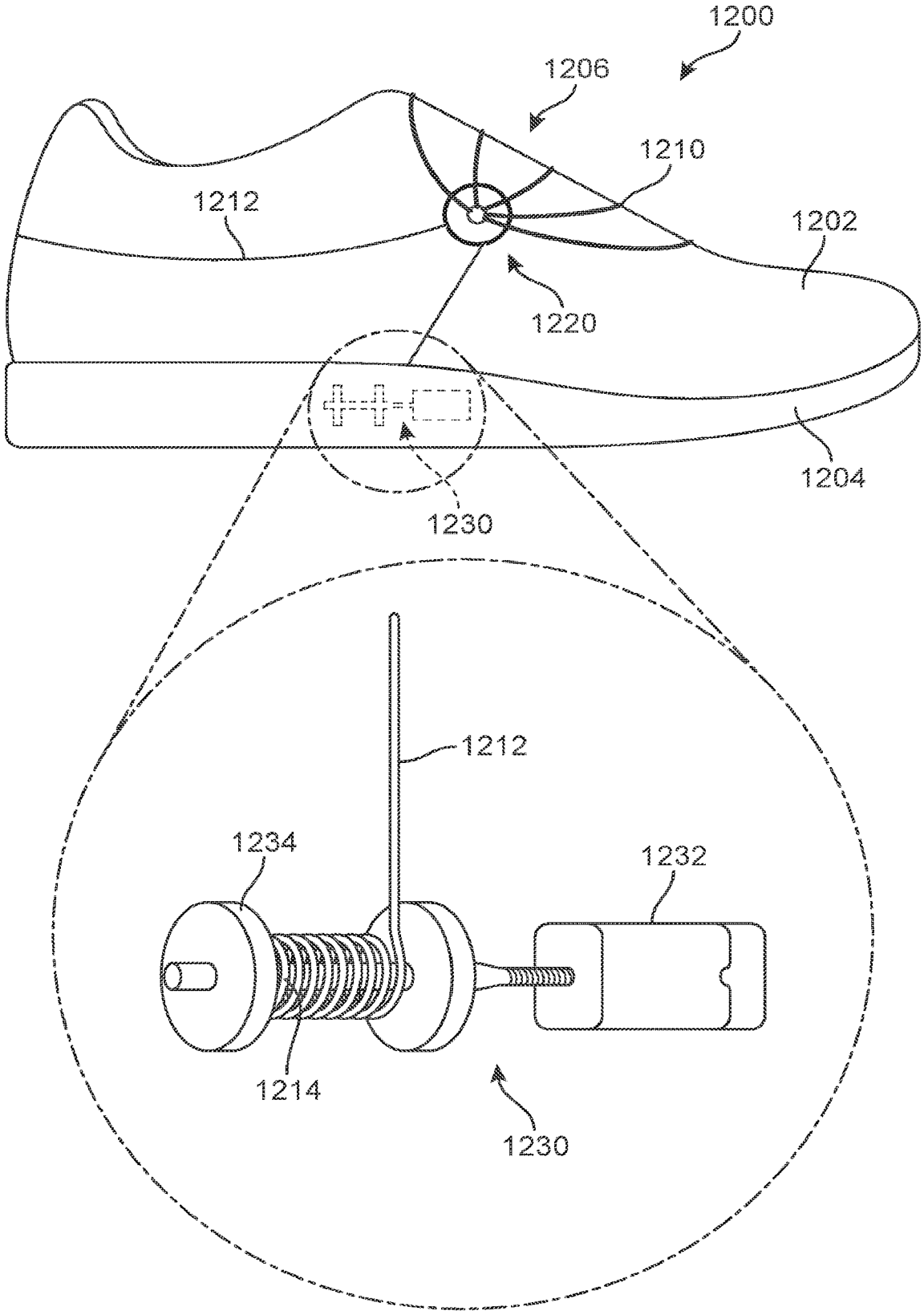
FIG. 25 is a schematic side view of the article of footwear of FIG. 24 in which the article of footwear has been tightened.

First end 1214 of tensioning cable 1212 may be attached to spool 1234 so that tensioning cable 1212 may be wound (or unwound) around spool 1234 to vary tension across article 1200. In some cases, a second end (not shown) of tensioning cable 1212 could be secured to a part of upper 1202, such as the heel. As shown in FIG. 25, as tensioning cable 1212 is wound onto spool 1234 (by motor 1232), pulley assembly 1220 may move across the surface of upper 1202 as the loads across tensioning cables 1210 and tensioning cable 1212 are dynamically adjusted.

As seen in FIGS. 24-25, a pulley assembly can be configured to move to different positions across an upper as forces are applied by one or more tensioning elements. This may allow for a more dynamic balancing of loads across a tensioning system as the position of a pulley assembly can be varied in response to changes in loads in the tensioning system.

A pulley assembly can be used to reduce friction in a tensioning element (e.g., cable, lace, etc.). In some embodiments, one or more pulley assemblies could be used in place of eyelets on an article of footwear.

Figure 26:
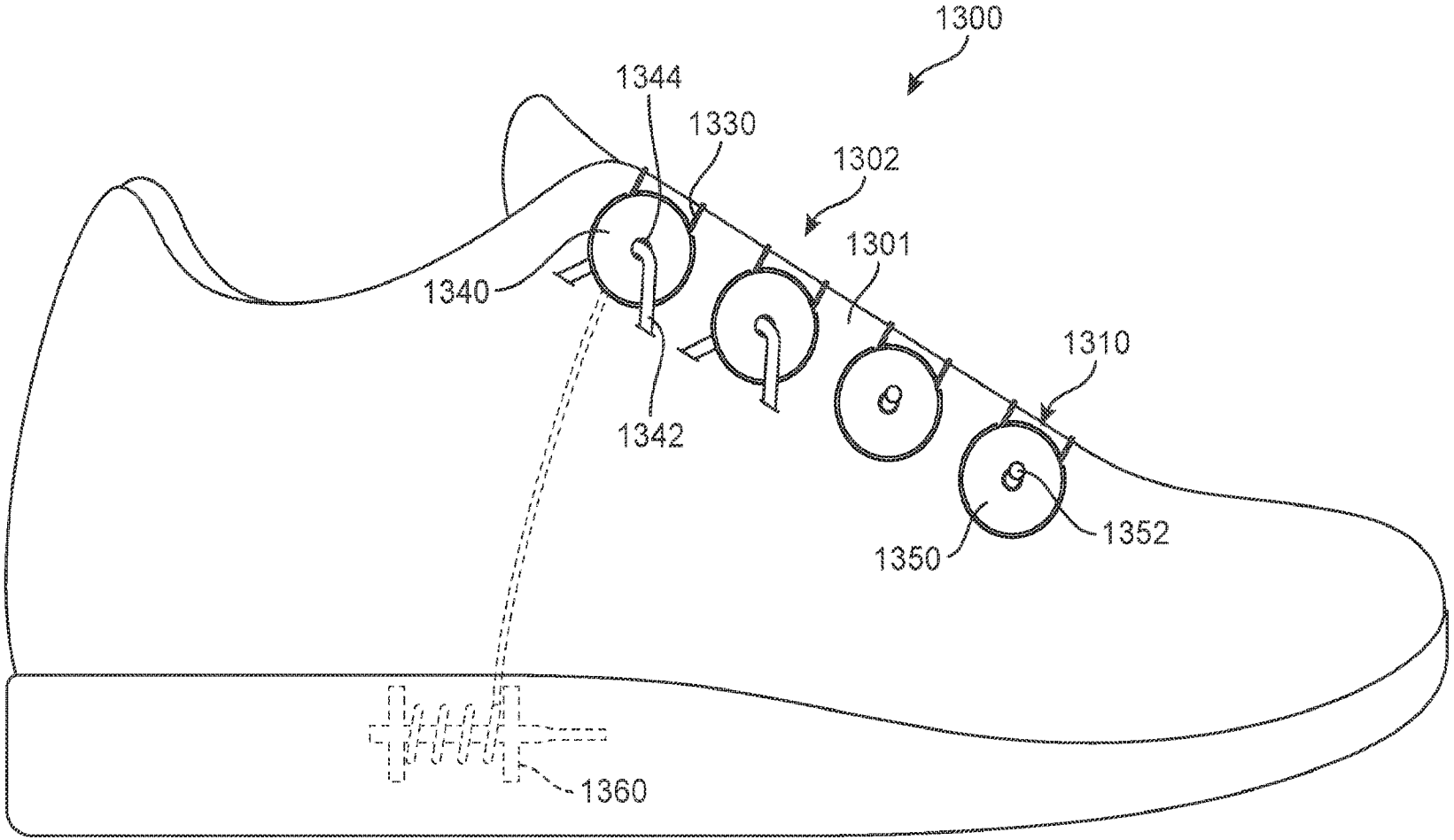
FIG. 26 is a schematic side view of an embodiment of an article of footwear with a fastening system incorporating a plurality of pulley assemblies.
Figure 27:
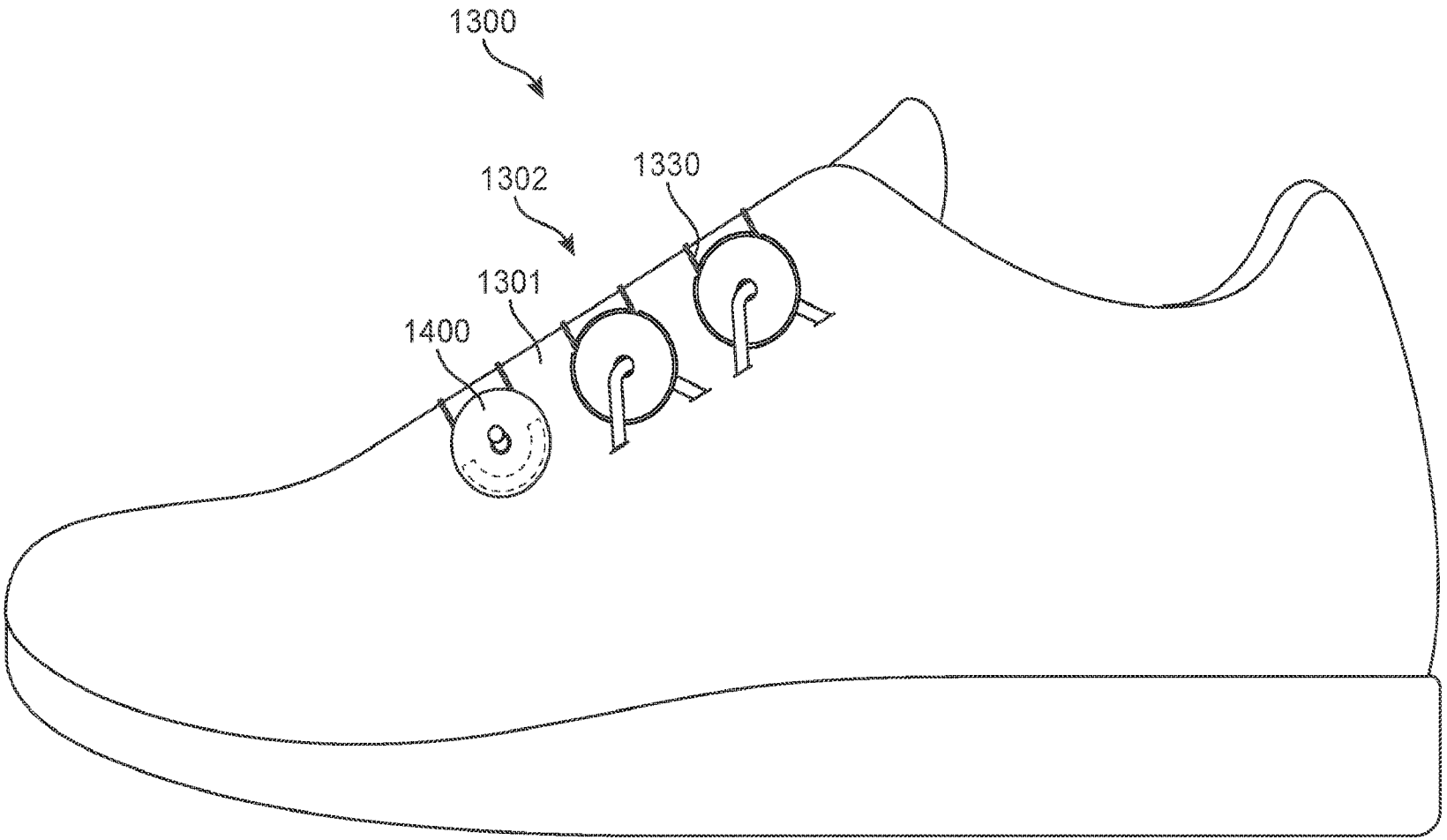
FIG. 27 is a schematic side view of the article of footwear of FIG. 26.

FIG. 26 is a schematic view of an embodiment of article of footwear 1300, or simply article 1300. FIG. 27 is a schematic view of an opposing side of article 1300 from the side shown in FIG. 26. Referring to FIGS. 26-27, article 1300 includes fastening system 1302 that may be used to tighten throat 1301 of article 1300. Fastening system 1302 may be comprised of plurality of pulley assemblies 1310. In the embodiment of FIGS. 26-27, each pulley assembly is shown as a pulley with an external ring element, as described in detail above and shown in FIGS. 13-15. However, in other embodiments, one or more pulley assemblies could be replaced with a pulley assembly incorporating an inner ring element, as shown in FIGS. 2-4.

Tensioning cable 1330 may be wound around each pulley of plurality of pulley assemblies 1310. In some embodiments, ends of tensioning cable 1330 could be routed through article 1300 to spool 1360. Winding tensioning cable 1330 would then act to tighten throat 1301 around a foot. In contrast to a traditional lacing system, however, the use of pulley assemblies for routing laces may provide significantly less friction along the path of the lace and provide for more stable tensioning of article 1300.

As seen in FIGS. 26 and 27, pulley assemblies could be coupled to an article in various ways. As one example, pulley assembly 1340 may be coupled using cable loop 1342 that passes through aperture 1344 of pulley assembly 1340. Cable loop 1342 may be stitched at its ends directly to article 1300 (e.g., the upper). Alternatively, as another example, pulley assembly 1350 may be mounted directly to post 1352 that is itself fixed to article 1300. In still other embodiments, a pulley assembly could be directly glued to the upper of an article.

FIG. 27 also shows an example of using pulley assembly 1400 with an internal ring, rather than an external ring. Therefore, it may be appreciated that pulley assemblies with either external ring elements or internal ring elements could be used, as well as various combinations of these types.

In different embodiments, different tensioning elements in a tensioning system could have different material properties. In some embodiments, a tensioning element extending around a pulley shaft may have a lower modulus of elasticity than a tensioning element extending through a central aperture of the pulley shaft. In other embodiments, a tensioning element extending around a pulley shaft may have a higher modulus of elasticity than a tensioning element extending through a central aperture of the pulley shaft. In still other embodiments, two or more tensioning elements could have equal moduli of elasticity.

Embodiments can include provisions for ensuring that a pulley is not twisted with respect to a surface of an upper by one or more tensioning members. In some embodiments, a pulley could be assembled with an external housing that includes provisions to prevent tensioning members from entering, for example, an aperture through the shaft of the pulley in a manner that would result in twisting of the pulley away from the upper surface. In some embodiments, such provisions could include a guide that helps control the entry angle of a tensioning member to and from the pulley.

Figure 28:
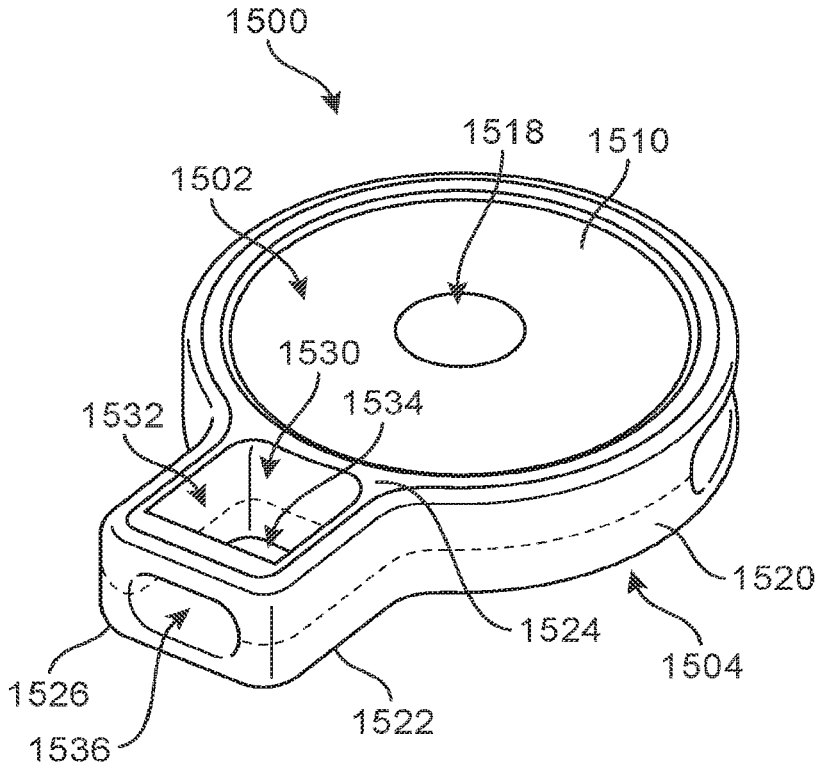
FIG. 28 is a schematic isometric view of an embodiment of a pulley assembly.
Figure 29:
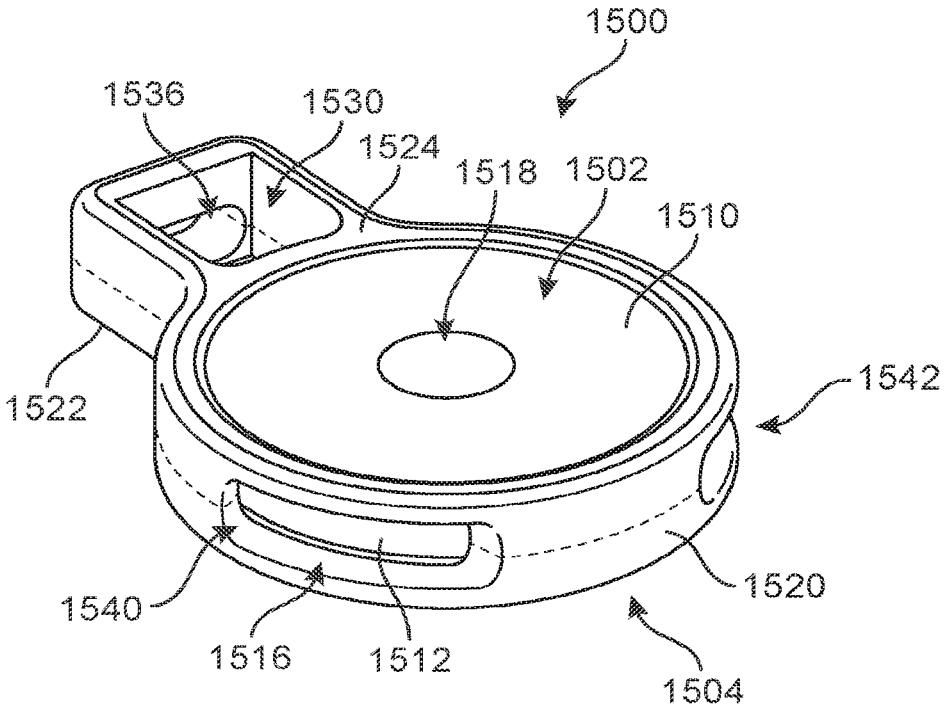
FIG. 29 is another schematic isometric view of the pulley assembly of FIG. 28.
Figure 30:
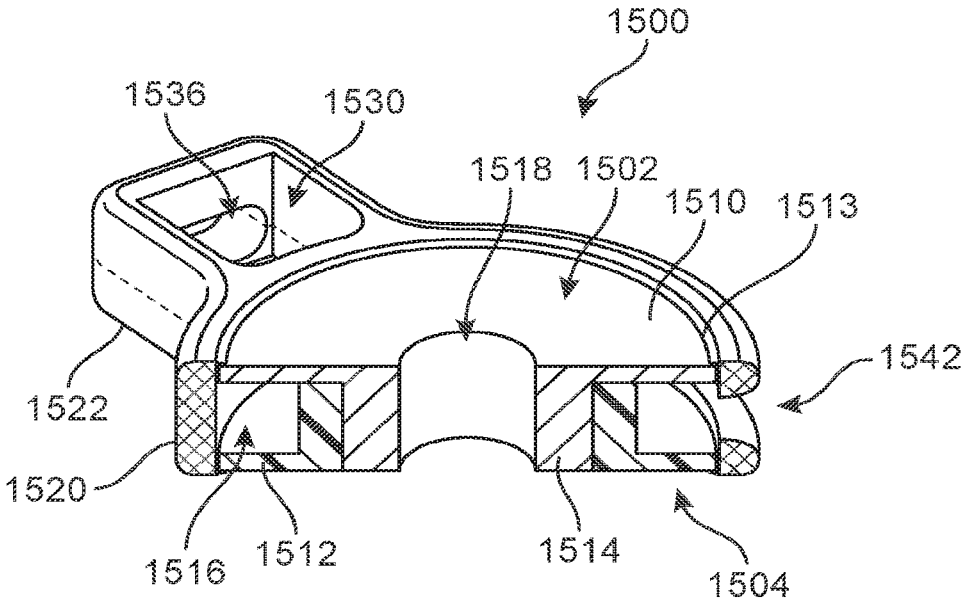
FIG. 30 is a schematic isometric cut-away view of the pulley assembly of FIG. 29.

FIGS. 28-30 illustrate schematic isometric views (including an isometric cut-away view shown in FIG. 30) of an embodiment of pulley assembly 1500. Pulley assembly 1500 may include pulley 1502 as well as external pulley housing 1504. In some embodiments, pulley 1502 may share some or more features with any pulley described herein, including pulley 202 (see FIG. 1) and the pulley comprised of first disc 814, second disc 834, and central shaft 870 (see FIG. 15). In other embodiments, pulley 1502 could differ in one or more respects from pulleys described previously. As best seen in FIG. 30, pulley 1502 may include first disc 1510, second disc 1512, and central shaft 1514. First disc 1510 and second disc 1512 are further separated by circumferential gap 1516. In addition, pulley 1502 includes aperture 1518 that extends through central shaft 1514, and which is generally aligned with the central axis of pulley 1502.

External pulley housing 1504 may include provisions for retaining pulley 1502 and preventing a tensioning member that may be wrapped around central shaft 1514. As seen in FIGS. 28-30, external pulley housing 1504 includes external ring portion 1520 and guide portion 1522. External ring portion 1520 may be similar to external ring element 850 (see FIG. 15). In particular, external ring portion 1520 may encircle some or all of pulley 1502 and can block access to circumferential gap 1516 along at least a portion of the circumference of pulley 1502.

External ring portion 1520 can include one or more provisions for securing pulley 1502 in external pulley housing 1504. In some cases, external ring portion 1520 can include an inwardly extending portion that is received in circumferential gap 1516 and acts to retain pulley 1502 within external ring portion 1520. In other cases, top opening 1532 in external ring portion 1520 may have a smaller diameter than pulley 1502, thus preventing pulley 1502 from sliding out of external ring portion 1520 through top opening 1532. Similarly, a bottom opening (not shown) can have a smaller diameter than pulley 1502. For example, in the exemplary embodiment, first disc 1510 and second disc 1512 comprise lip portions 1513 (see FIG. 30) that reduce the size of the top and bottom openings of external ring portion 1520, thereby retaining pulley 1502 within external ring portion 1520.

In some embodiments first circumferential opening 1540 and second circumferential opening 1542 (best seen in FIG. 29) may be provided on external ring portion 1520 so as to provide access to circumferential gap 1516. Although the embodiment of FIGS. 28-31 includes two circumferential openings, other embodiments could include a single opening, while still others could include three or more openings.

Guide portion 1522 may extend distally from external ring portion 1520 from proximal end 1524 (connected to external ring portion 1520) to distal end 1526. In some embodiments, external pulley housing 1504 is shaped so that distal end 1526 of guide portion 1522 is disposed further from aperture 1518 than any other portion of external pulley housing 1504. As seen in FIGS. 28-29, guide portion 1522 may include inner open chamber 1530 that is accessible from top opening 1532, opposing bottom opening 1534, and distal opening 1536. More specifically, top opening 1532 may be oriented in a similar plane, or parallel to a plane associated with first disc 1510, while bottom opening 1534 may be oriented in a similar plane, or parallel to a plane associated with second disc 1512. In contrast, distal opening 1536 may be oriented in a direction perpendicular to top opening 1532 and bottom opening 1534, at least in some embodiments. As discussed in further detail below, this arrangement allows top opening 1532 and bottom opening 1534 to receive portions of a tensioning member that can be directed through inner open chamber 1530 and distal opening 1536 so as to restrict the entry angle of the tensioning member.

In different embodiments, the relative dimensions of a guide portion and an external ring portion could vary. In some embodiments, a guide portion may have a similar thickness, or height, to the external ring portion. In other embodiments, however, a guide portion could have a different thickness or height than the external ring portion. Likewise, in some embodiments a guide portion could have a width that is smaller than a diameter of a pulley or of the external ring portion. The width of the guide portion may be selected to control the available entry angles of a tensioning member.

In different embodiments, the geometry of one or more portions or components could vary. In the embodiment shown in FIGS. 28-30, pulley assembly 1500 includes a circular (in horizontal cross section) external ring portion, as well as a rectangular (in horizontal cross section) guide portion. However, in other embodiments the shapes/geometries and/or relative sizes of these components could differ from the illustrated embodiments.

Figure 31:
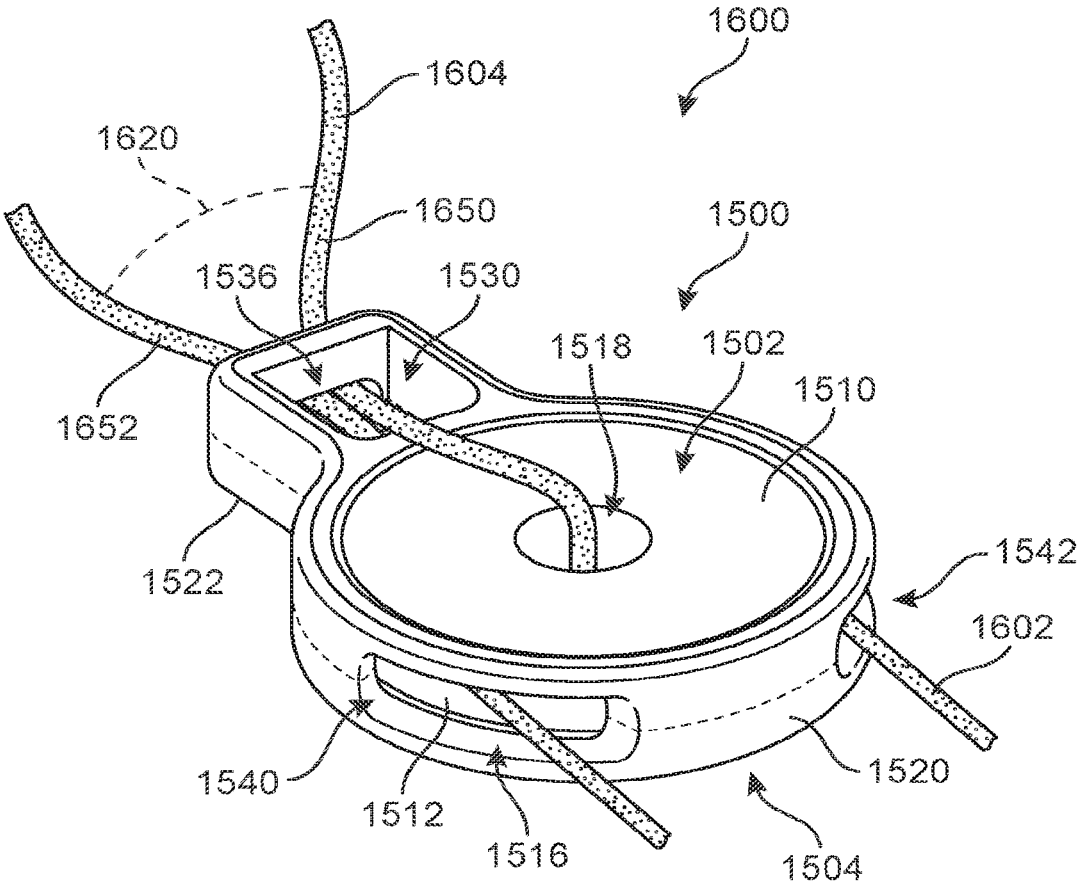
FIG. 31 is a schematic view of a tensioning system for an article of footwear, according to an embodiment.

FIG. 31 is a schematic view of tensioning assembly 1600 according to an embodiment. Tensioning assembly 1600 includes pulley assembly 1500 as well as first tensioning member 1602 and second tensioning member 1604. As seen in FIG. 31, first tensioning member 1602 may enter first circumferential opening 1540 of external pulley housing 1504, wrap around central shaft 1514 and exit through second circumferential opening 1542. First guided portion 1650 of second tensioning member 1604 may enter through distal opening 1536, pass through inner open chamber 1530 and through top opening 1532, through aperture 1518. Second guided portion 1652 of second tensioning member 1604 may exit the opposing side of aperture 1518 and may pass back through bottom opening 1534, and out through distal opening 1536. This arrangement provides a restricted entry angle 1620 for second tensioning member 1604, which may help reduce unwanted twisting of pulley assembly 1500 against an upper. Such twisting may occur in embodiments where second tensioning member 1604 exits directly from opposing openings of aperture 1518 so that as tension is applied along second tensioning member 1604 the central axis of the pulley may be pulled into a position parallel with the surface of an upper, rather than in a more desirable perpendicular orientation where pulley assembly 1500 lays flat against an underlying surface. Thus, in some embodiments, guide portion 1522 may provide increased control for a tensioning assembly.

It may be appreciated that tensioning assembly 1600 can be provided on an article in a similar manner to the configurations described above and shown, for example, in FIGS. 1 and 25-27. Moreover, in some cases, first tensioning member 1602 could be a lace while second tensioning member 1604 could be a tensioning member (such as a metal or plastic wire) with a narrower diameter and/or that is less elastic or stretchable than the lace. Such a configuration would allow second tensioning member 1604 to act as an anchor for pulley assembly 1500 while first tensioning member 1602 could be an element in a fastening system (like a lacing system).

While various embodiments have been described, the description is intended to be exemplary, rather than limiting, and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

What is claimed is:

1. A pulley assembly, comprising:

a pulley having:

a first disc, a second disc, and a central shaft extending between the first disc and the second disc, the central shaft being formed by at least one of the first disc and the second disc;

a circumferential gap formed by the first disc and the second disc and extending around a compete circumference of the first and second discs, the circumferential gap bounded n a radial direction by the central shaft, the circumferential gap configured to admit a portion of a tensioning member therethrough;

wherein the pulley includes an aperture extending through the central shaft;

an external pulley housing including an external ring portion and a guide portion; the external ring portion configured to slide or translate in a circumferential direction through the circumferential gap, wherein the ring element is configured to prevent the tensioning member from falling out of the circumferential gap;

wherein the guide portion extends from the external ring portion, the guide portion including an open chamber;

wherein the guide portion includes a top opening and an opposing bottom opening that provide access to the open chamber; and wherein the guide portion includes a distal opening on a distal end of the guide portion that provides access to the open chamber.

2. The pulley assembly according to claim 1, wherein the distal end of the guide portion is disposed further from the aperture than any other portion of the pulley assembly is disposed from the aperture.

3. The pulley assembly according to claim 1, wherein the external ring portion includes at least one opening that provides access to the circumferential gap.

4. The pulley assembly according to claim 1, wherein the guide portion has a similar height to the external ring portion.

5. The pulley assembly according to claim 1, wherein a width of the guide portion is less than a diameter of the pulley.

6. The pulley assembly according to claim 1, wherein the external ring portion has a circular cross-sectional shape and wherein the guide portion has a rectangular cross-sectional shape.

7. The pulley assembly according to claim 1, wherein a top opening in the external ring portion and a bottom opening in the external ring portion both have diameters less than a diameter of the pulley to keep the pulley retained within the external pulley housing.

8. The pulley assembly according to claim 1, wherein the external ring portion includes an inwardly extending portion that is received in the circumferential gap to keep the pulley retained within the external pulley housing.

9. A tensioning system for an article of footwear, comprising:

a pulley assembly with:

a pulley comprising a first disc, a second disc, and a central shaft extending between the first disc and the second disc, the central shaft being formed by at least one of the first disc and the second disc;

a circumferential gap formed by the first disc and the second disc and extending around a complete circumference of the first and second discs, the circumferential gap bounded in a radial direction by the central shaft;

an aperture extending through the central shaft;

an external pulley housing including an external ring pardon and a guide pardon; the external ring portion configured slide or translate in a circumferential direction through the circumferential gap;

wherein the guide pardon extends from the external ring portion, the guide pardon including an open chamber;

wherein the guide pardon includes a top opening and an opposing bottom opening that provide access to the open chamber; and wherein the guide pardon includes a distal opening on a distal end of the guide portion that provides access to the open chamber; a first tensioning member with a first pardon extending through at least a portion of the circumferential gap and around the central shaft, wherein the external ring portion is configured to prevent the first tensioning member from falling out of the circumferential gap; and a second tensioning member with a second portion extending through the aperture.

10. The pulley assembly according to claim 9, wherein the distal end of the guide portion is disposed further from the aperture than any other portion of the pulley assembly is disposed from the aperture.

11. The pulley assembly according to claim 9, wherein the external ring portion includes at least one opening that provides access to the circumferential gap.

12. The pulley assembly according to claim 9, wherein the guide portion has a similar height to the external ring portion.

13. The pulley assembly according to claim 9, wherein a width of the guide portion is less than a diameter of the pulley.

14. The pulley assembly according to claim 9, wherein the second tensioning member includes a first guided portion extending through the top opening of the guide portion, through the open chamber and through the distal opening.

15. The pulley assembly according to claim 14, whereine second tensioning member includes a second guided portion extending through the bottom opening of the guide portion, through the open chamber and through the distal opening.

16. The pulley assembly according to claim 9, wherein the first tensioning member is a shoelace.

17. The pulley assembly according to claim 16, wherein the second tensioning member has a smaller diameter than the shoelace.

18. The pulley assembly according to claim 16, wherein the second tensioning member is less elastic than the shoelace.

* * * * *